US006409317B1

(12) United States Patent
Shimazu et al.

(10) Patent No.: US 6,409,317 B1
(45) **Date of Patent: *Jun. 25, 2002**

(54) LIQUID DISCHARGE HEAD, LIQUID DISCHARGE METHOD AND LIQUID DISCHARGE APPARATUS

(75) Inventors: Satoshi Shimazu, Yokohama; Sadayuki Sugama, Tsukuba; Hiroyuki Ishinaga, Tokyo; Yoichi Taneya, Yokohama; Hiroyuki Sugiyama, Sagamihara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/376,356

(22) Filed: Aug. 18, 1999

(30) Foreign Application Priority Data

| | | |
|---|---|---|
| Aug. 21, 1998 | (JP) | 10-236117 |
| Aug. 21, 1998 | (JP) | 10-236120 |
| Aug. 21, 1998 | (JP) | 10-236122 |
| Aug. 21, 1998 | (JP) | 10-236123 |
| Aug. 21, 1998 | (JP) | 10-236124 |
| Aug. 21, 1998 | (JP) | 10-236125 |
| Aug. 21, 1998 | (JP) | 10-236126 |

(51) Int. Cl.[7] ..... B41J 2/05
(52) U.S. Cl. ..... 347/65
(58) Field of Search ..... 347/63, 65, 67, 347/92, 94

(56) References Cited

U.S. PATENT DOCUMENTS

| | | | | |
|---|---|---|---|---|
| 4,723,129 A | | 2/1988 | Endo et al. | 347/56 |
| 5,278,585 A | | 1/1994 | Karz et al. | 347/65 |
| 5,821,962 A | | 10/1998 | Kudo et al. | 347/65 |
| 5,841,448 A | | 11/1998 | Moriyama et al. | 347/19 |
| 5,943,074 A | | 8/1999 | Kashino et al. | 347/54 |
| 6,109,735 A | * | 8/2000 | Kashino et al. | 347/65 |
| 6,168,264 B1 | | 1/2001 | Yoshihira et al. | 347/65 |

FOREIGN PATENT DOCUMENTS

| | | | |
|---|---|---|---|
| EP | 0 436 047 | 7/1991 | B41J/2/055 |
| EP | 0 721 841 | 7/1996 | B41J/2/05 |
| EP | 0 739 734 | 10/1996 | B41J/2/045 |
| EP | 0 811 492 | 12/1997 | B41J/2/05 |
| EP | 0 816 087 | 1/1998 | B41J/2/05 |
| EP | 0 819 530 | 1/1998 | B41J/2/05 |
| JP | 6-31918 | 2/1994 | B41J/2/05 |
| JP | 9-48127 | 2/1997 | B41J/2/05 |
| JP | 9-323420 | 12/1997 | B41J/2/05 |
| JP | 10-24588 | 1/1998 | B41J/2/05 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharge head comprises heating members for generating thermal energy to create bubbles in liquid, discharge ports forming the portions to discharge the liquid, liquid flow paths communicated with the discharge ports, at the same time, having bubble generation areas for enabling liquid to create bubbles, movable members arranged in the bubble generation areas to be displaced along with the development of the bubbles, and regulating members to regulate the displacement of each of the movable members within a desired range, and with energy at the time of bubble creation, the liquid being discharged from the discharge ports. For this liquid discharge head, each of the liquid flow paths holds bubbles at the time of bubbling, at the same time, being provided with gaps arranged on the sides of the movable member to allow the liquid on the upstream thereof to flow into the bubble generation area at the time of bubble disappearing. With the structure thus arranged, the meniscus is drawn into the liquid flow path quickly immediately after the bubble disappearing of bubble begins, and then, with a strong force of the meniscus, the trailing portion of the liquid column connected with the discharged droplet is cut off outside the discharge port, hence making the number of satellites smaller for the enhancement of the quality of prints.

86 Claims, 17 Drawing Sheets

LIQUID DISCHARGE HEAD, LIQUID DISCHARGE METHOD AND LIQUID DISCHARGE APPARATUS

BACKGROUND OF THE INVENTION

1. Field of the Invention

The present invention relates to a liquid discharge head that discharges a desired liquid by the bubbles created by the application of thermal energy acting upon the liquid, and also, relates to the head cartridge and the liquid discharge apparatus using such liquid discharge head. More particularly, the invention relates to a liquid discharge head provided with the movable members which are displaceable by the utilization of the creation of bubbles, as well as to a head cartridge and a liquid discharge apparatus using such liquid discharge head.

Also, the present invention is applicable to a printer capable of recording on a recording medium, such as paper, thread, textile, cloth, leather, metal, plastics, glass, wood, and ceramics, among some others. The invention is also applicable to a copying machine, a facsimile equipment having communication systems, and an apparatus, such as a wordprocessor, which is provided with a printer. The invention is also applicable to a recording system for industrial use arranged complexly in combination with various processing apparatuses.

Here, in the specification of the present invention, the term "record" means not only the provision of characters, graphics, and other meaningful images, but also, it means the provision of patterns or other images, which do not present any particular meaning, for a recording medium.

2. Related Background Art

There has been known the ink jet recording method, that is, the so-called bubble jet recording method in which energy, such as heat, is given to ink to cause the change of states thereof which is accompanied by the abrupt voluminal changes (creation of bubbles), and ink is discharged from the discharge ports by the acting force based on this change of states, and then, the discharged ink is allowed to adhere to a recording medium for the formation of images. The recording apparatus using this bubble jet recording method is generally provided with the discharge ports for discharging ink; the ink flow paths communicated with the discharge ports; and the electrothermal transducing devices each arranged in each of the ink flow paths, serving as means for generating energy used for discharging ink as disclosed in the specifications of U.S. Pat. No. 4,723,129, and others.

In accordance with a recording method of the kind, it is possible to record high quality images at higher speeds in a lesser amount of noises. At the same time, with the head whereby to execute this recording method, it becomes possible to arrange the discharge ports for discharging ink in higher density, among many other advantages, hence obtaining recorded images in higher resolution with a smaller apparatus, as well as obtaining images in colors with ease. In recent years, therefore, the bubble jet recording method is widely utilized for many kinds of office equipment, such as printer, copying machine, facsimile equipment, and further, utilized for the textile printing system and others for the industrial use.

Now, along with the wider utilization of the bubble jet technologies and techniques for the products currently in use in many fields, there have been various demands increasingly more in recent years as given below.

In order to obtain images in higher quality, the driving condition is proposed anew so that the liquid discharge method or the like should be arranged to perform good ink discharges on the basis of the stabilized creation of bubbles that enables ink to be discharge at higher speeds. Also, from the viewpoint of the higher recording, there has been proposed the improved configuration of flow paths so as to obtain the liquid discharge head which is capable of performing in the liquid flow paths the higher refilling for the liquid that has been discharged.

Besides a head of the kind, an invention is disclosed in the specification of Japanese Patent Application Laid-Open No. 6-31918 (particularly, with reference to FIG. 3 in the Application) in which attention is given to the back waves (the pressure directed in the direction opposite to the one toward the discharge ports) which are generated along with the creation of bubbles, and then, the structure is arranged to prevent such back waves because the back waves result in the energy loss in performing discharges. In accordance with the invention disclosed in the specification thereof, the triangle portion of a triangular plate member is arranged to face each heater that creates bubbles. The invention can suppress the back waves temporarily and slightly by means of such plate member thus arranged. However, there is no reference at all as to the correlations between the development of bubbles and the triangular portion nor any idea is disclosed as to dealing with such correlations. Therefore, this invention still present the problems as given below.

In other words, the invention thus disclosed is designed to locate the heaters on the bottom of a recessed portion, thus making it difficult to provide the condition where the heaters can be communicated with the discharge ports on the straight line. As a result, each liquid droplet is not stabilized in keeping its shape uniformly. At the same time, since the development of each bubble is allowed to take place beginning with the circumference of each apex of the triangular portions, the bubble is developed from one side of the triangular plate member to the opposite side entirely. Consequently, the development of each bubble is completed in the liquid as has been usually effectuated as if there were no presence of the triangular plate members. Here, as to the bubble development, therefore, the presence of the plate members has no bearing at all. On the contrary, the entire body of each plate member is embraced by each bubble, and in the stage where the bubble is contracted, this condition may bring about the disturbance in the refilling flow to each of the heaters located in the recessed portion. As a result, fine bubbles are accumulated in the recessed portion, which may disturb the principle itself with which to perform discharges on the basis of the development of bubbles.

Meanwhile, in accordance with the laid-open EP publication 436047A1, an invention has been proposed to alternately open and close a first shut off valve arranged between the area in the vicinity of discharge ports and the bubble generating portion, and a second valve which is arranged between the bubble generating portion and the ink supply portion in order to shut them off completely (as shown in FIGS. 4 to 9 of the EP436047A1). However, this invention inevitably partitions each of the three chambers into two, respectively. As a result, the ink that follows the liquid droplet presents a great trailing at the time of discharge, which creates a considerable amount of satellite dots as compared with the usual discharge method where the development, contraction, and extinction are performed for each of bubbles (presumably, there is no way to effectively utilize the resultant retraction of meniscus in the process of the bubble disappearing). Also, at the time of refilling, liquid should be supplied to the bubble generating portion following the bubble disappearing of each bubble. However, since it is impossible to supply liquid to the vicinity of each discharge port until the next bubbling takes place, not only the size of each discharge liquid droplet varies greatly, but also, the frequency of discharge responses becomes extremely smaller. This proposed invention is, therefore, far from being practical.

On the other hand, the applicant hereof has proposed a number of inventions that may contribute to the performance of effective discharges of liquid droplets, which use the movable member (the plate member or the like that has its free end on the discharge port side of its fulcrum) unlike the conventional art. Of the inventions thus proposed, the one disclosed in the specification of Japanese Patent Application Laid-Open No. 9-48127 is such as to regulate the upper limit of the displacement of the movable member in order to prevent even a slight disturbance of the behavior of the movable member as described above. Also, in the specification of Japanese Patent Application Laid-Open No. 9-323420, there is the disclosure of an invention that the position of the common liquid chamber on the upstream of the aforesaid movable member is arranged to be shiftable to the downstream side, that is the free end side of the movable member, by the utilization of the advantage presented by the movable member so as to enhance the refilling capability. However, for these inventions, no attention has been given to each individual element of bubbling as a whole which is concerned with the formation of the liquid droplet, or to the correlations between each of them, because in the premises set forth for the designing the invention, the mode has been adopted so that the bubble is released to the discharge port side at once from the state where the development of the bubble is temporarily embraced by the movable member.

Then, in the next stage to follow in this respect, the applicant hereof has disclosed in Japanese Patent Application Laid-Open No. 10-24588 the invention that a part of the bubble generation area is released from the movable member as a new devise (acoustic waves) with the attention given to the development of bubble by the application of the propagation of pressure waves, which constitutes the element related to the liquid discharges. However, for this invention, too, the attention is given only to the development of each bubble at the time of liquid discharges. As a result, each individual element related to the formation of the liquid droplet itself, with which bubbling is concerned as a whole, nor the correlations between each of them is taken into consideration when the invention is designed.

Although it has been known that the front portion (edge shooter type) of the bubble created by means of the film boiling exerts a great influence on the discharges, there is no invention in which attention has ever been given to this particular portion so as to make it effectively contributive to the formation of each discharge liquid droplet. The inventors hereof have ardently studied this portion in order to elucidate it technically when designing the invention taken out for patent herein.

From the viewpoint of the formation of discharge liquid droplets, the precise analyses are made as to the processes from the creation of each bubble to the bubble disappearing thereof. Then, a number of inventions are designed as a result of such precise analyses. The present invention is one of them thus devised for the reduction of the satellites which are characteristic of ink jetting, and which tend to lower the quality of prints, and also, cause the apparatus itself and the recording medium to be stained. As compared with the conventional art, the present invention makes it possible to attain an extremely high technical standard with respect to the stabilization of the image quality in the execution of the continuous discharge operation.

SUMMARY OF THE INVENTION

The main objectives of the present invention are as follows:

A first object of the invention is to provide an extremely novel liquid discharge principle under which the created bubbles and the liquid on the discharge port side thereof, as well as the liquid on the supply side, are suppressed by the presence of the movable members and the structural arrangement of the entire liquid flow paths.

A second object of the invention is to provide a liquid discharge method and a liquid discharge head with which the reduction of satellites is implemented by controlling the formation process of each discharge liquid droplet, and substantially the satellites in the discharge operation is eliminated.

A third object is to lighten the system load of the structure needed for a recording apparatus to make it possible to remove the drawbacks resulting from the presence of satellites and the fluctuation of meniscus.

In order to achieve these objectives, the liquid discharge head of the invention comprises a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port. For this liquid dischrge head, the liquid flow path holds bubble at the time of bubbling, being provided with a gap arranged on side of the movable member to allow the liquid on the upstream of the movable member to flow into the bubble generation area at the time of bubble disappearing.

Also, the liquid discharge head of the invention comprises a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port. For this liquid discharge head, the regulating member is arranged to face the bubble generating area of the liquid flow path, and the liquid flow path having the bubble generation area becomes an essentially closed space with the exception of the discharge port when the vicinity of the free end of the displaced movable member is substantially in contact with each of the regulating member, and the movable member is displaced to be resiliently extruded to the upstream side before the bubble presents the maximum volume, and then, the extruded portion thereof is displaced to the downstream side by the resiliency thereof in the stage of the bubble contraction.

Also, the liquid discharge head of the invention comprises a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port. For this liquid discharge head, the liquid flow path having the bubble generation area becomes an essentially closed space with the exception of the discharge port when the displaced movable member is substantially in contact with the regulating member, and, the bubble does not block the liquid flow in the space at the time of maximum bubbling.

Also, the liquid discharge head of the invention comprises a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port. For this liquid discharge head, the liquid flow path having the bubble generation area becomes an essentially closed space with the exception of the discharge port when the displaced movable member is substantially in contact with the regulating member, and there exists the liquid facing the movable member when the bubble is developed to the maximum and being connected continuously with the liquid on the downstream side of the bubble generation area in the space.

Also, the liquid discharge head of the invention comprises a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port. For this liquid discharge head, the liquid flow path having the bubble generation area becomes an essentially closed space with the exception of the discharge port when the displaced movable member is substantially in contact with the regulating member, and the bubble does not cover the substantially contacted portion of the movable member at the time of maximum bubbling.

Also, the liquid discharge head of the invention comprises a heating member for heating liquid in a liquid flow path to create bubble in the liquid; a discharge port communicated with the downstream side of the liquid flow path for discharging the liquid by the pressure along with the development of the bubble; a movable member arranged in the bubble generation area to be displaced along with the development of the bubble; a regulating member to regulate the displacement of the movable member within a desired range, and the heating member and the discharge port being in the linearly communicated state, and with energy at the time of bubble creation, the liquid being discharged from the discharge port. For this liquid dischrge head, the regulating member is arranged to face the bubble generation area, and the liquid flow path having the bubble generation area becomes an essentially closed space with the exception of the discharge port when the displaced movable member is substantially in contact with the regulating member, and the movable member covers a part of the heating member at the time of bubble extinction so as to cause the liquid on the area covered by the movable member to flow out from the side of the movable member.

Also, the liquid discharge head of the invention comprises a heating member for heating liquid in liquid flow path to create bubble in the liquid; a discharge port communicated with the downstream side of the liquid flow path for discharging the liquid by the pressure along with the development of the bubble; a movable member arranged in the bubble generation area to be displaced along with the development of the bubble; a regulating member to regulate the displacement of the movable member within a desired range, and the heating member and the discharge port being in the linearly communicated state, and with energy at the time of bubble creation, the liquid being discharged from the discharge port. For this liquid dischrge head, the regulating member is arranged to face the bubble generation area, and the liquid flow path having the bubble generation area becomes an essentially closed space with the exception of the discharge port when the displaced movable member is substantially in contact with the regulating member, and the movable member covers the extinct point of the bubble at the time of bubble extinction.

Also, the liquid discharge head of the invention comprises a discharge port for discharging liquid; a liquid flow path communicated with the discharge port, having a plurality of bubble generation areas for enabling liquid to create bubble; and movable member arranged in the liquid flow path to face the bubble generation area, having a free end on the downstream side with respect to the liquid flow in the direction toward the discharge port, the movable member being arranged only in the bubble generation area on the upstream side in the liquid flow direction toward the discharge port among the plurality of bubble generation areas.

Also, in order to achieve the objects described above, the liquid discharge apparatus of the invention comprises a liquid discharge head described in either one of the preceding paragraphs, and means for carrying a recording medium to carry the recording medium that receives liquid discharged from the liquid discharge head.

Further, for the achievement of the objects described above, the liquid discharge method of the invention, which uses a liquid discharge head provided with a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port, comprises the steps of holding the bubble by the movable member when the bubble is developed, and enabling the liquid on the upstream of the movable member to flow into the bubble generation area through the gap provided for the side of the movable member at the time of bubble disappearing.

Also, the liquid discharge method of the invention, which uses a liquid discharge head provided with a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port, comprises the steps of contacting the movable member essentially with the regulating member before the maximum bubbling of the bubble, displacing the movable member to be resiliently extruded to the upstream side to make the liquid flow path having the bubble generation area an essentially closed space with the exception of the discharge port, and displacing the extruded portion of the movable member to the downstream side by the resiliency thereof in the contracting stage of the bubble.

Also, the liquid discharge method of the invention, which uses a liquid discharge head provided with a heating member for generating thermal energy to create bubble in liquid; a discharge port forming the portion to discharge the liquid; a liquid flow path communicated with the discharge port, having a bubble generation area for enabling liquid to create bubble; a movable member arranged in the bubble generation area to be displaced along with the development of the bubble; and a regulating member to regulate the displacement of the movable member within a desired range, and with energy at the time of bubble creation, the liquid being discharged from the discharge port, comprises the steps of contacting the movable member essentially with the regulating member before the maximum bubbling of the bubble, allowing no bubble to block the liquid flow in the space at the time of maximum bubbling.

Also, the liquid discharge method of the invention, which uses the liquid discharge head provided with a heating member for heating liquid in a liquid flow path to create bubble in the liquid; a discharge port communicated with the downstream side of the liquid flow path for discharging the liquid by the pressure along with the development of the bubble; a movable member arranged in the bubble generation area to be displaced along with the development of the bubble; a regulating member to regulate the displacement of the movable member within a desired range, and the heating member and the discharge port being in the linearly communicated state, and with energy at the time of bubble creation, the liquid being discharged from the discharge port, comprises the steps of contacting the movable member essentially with the regulating member before the maximum bubbling of the bubble to make the liquid flow path having the bubble generation area in it an essentially closed space with the exception of the discharge port; enabling the movable member to cover a part of the heating member before the bubble disappearing of the bubble; and allowing the liquid on the area covered by the movable member to flow out from the sides of the movable member.

Also, the liquid discharge method of the invention, which uses the liquid discharge head provided with a heating member for heating liquid in a liquid flow path to create bubble in the liquid; a discharge port communicated with the downstream side of the liquid flow path for discharging the liquid by the pressure along with the development of the bubble; a movable member arranged in the bubble generation area to be displaced along with the development of the bubble; a regulating member to regulate the displacement of the movable member within a desired range, and the heating member and the discharge port being in the linearly communicated state, and with energy at the time of bubble creation, the liquid being discharged from the discharge port, comprises the steps of contacting the movable member essentially with the regulating member before the maximum bubbling of the bubble to make the liquid flow path having the bubble generation area in it an essentially closed space, and enabling the movable member to cover the bubble disappearing point of the bubble at the time of the bubble disappearing of the bubble.

In accordance with the valve mechanism of the movable members of the present invention, it becomes possible to suppress the deflection of each movable member by allowing the bubble to be extruded around the backface of the movable member, hence stabilizing the discharge characteristics. Further, at the time of bubble disappearing, a "well" type condition is formed in each of the bubble generation areas to eliminate the residual bubble accumulation and the heat accumulation in the vicinity of each heating member even for the structure having no liquid circulation systems in it. Also, it is possible to prevent or suppress the liquid shift in the upstream diection which follows the back waves, that is, the pressure waves in the upstream direction. The resistance that liquid receives from each liquid flow path is made smaller to enhance the refilling capability. Also, the inertia exerted by the back waves that may act in the direction opposite to the liquid supply direction is suppressed, and the meniscus is drawn rapidly into each dischrge port. However, such rapid draw of meniscus is controlled to cease before the amount of meniscus retraction becomes greater. In this manner, the creation of satellite dots is prevented to improve the refilling frequency, and the printing speed, among others. Moreover, the vibrations of the meniscus is suppressed to stabilize discharges for the enhancement of the quality of prints. Also, when the valve mechanism is allowed to act by the creation of bubbles, the resistance that each of the movable members receives from the liquid flow path is made smaller up to a specific dispalcement postion of the movable member so that the movable member can reach an appropriate displacement position quickly. In this way, the discharge efficiency is improved.

Also, in accordance with the present invention, before the major refilling is initiated, the inertia in the stationary condition as described above is relaxed to initiate its shift in the refilling direction. As a result, the refilling can be performed stably and quickly, which contributes to the formation of liquid droplets sufficiently. Also, the meniscus is drawn into each discharge port rapidly, the liquid shift in the upstream direction, which follows the back wave, that is, the pressure waves in the upstream direction, is suppressed to prevent the creation of satellite dots for the stabilization of discharge amount and the enhancement of the quality of prtints.

Also, in accordance with the present invention, it is possible to suppress the liquid shift in the upstream direction following the back waves, that is, the pressure waves in the upstream direction, and at the same time, secure the liquid flow, that is, fluid, in good condition by allowing the bubble to release the closed space, particularly the portion where each movable member is in contact, from the state of being blocked when the volume of the bubble is reduced to initiate the refilling subsequent to the formation of the essentially closed space based upon the development of the bubble. Hence, it becomes possible to enable each movable member to be restored at a high speed, and stabilize the discharge amount for the enhancement of the quality of prints.

Also, in accordance with the present invention, it is arranged to secure the fluid current with respect to the narrow space (approxiamtely 10 micron) between the fulcrum side of each movable member and the bubble generation area by the utilization of cavitation, thus making the entire refreshing possible.

Also, in accordance with the present invention, the formation of liquid droplets can be performed stably without creating the microdots. As a result, the overall qulaity of prints is improved.

Particularly with the structure of the present invention in which the trailing portion connected with the discahrged droplet to form the liquid column is cut off from the meniscus quickly for the high-speed settlement of the meniscus vibrations, it becmes possible to perform the higher-speed recording in higher quality by the higher liquid discharges by attaining good responses at the time of continuous discharges, as well as the stabilized formation of liquid dorplets.

Further, in accordance with the liquid discharge head of the present invention, each of the liquid flow paths is essentially divided with respect to the liquid flow in the direction toward the discharge port when the movable member is displaced to be in contact with the regualating member. As a result, it becomes possible to perform the discharges of liquid stable at high speeds following the development of bubble in each of the bubble generation areas. Further, it becomes possible to attain the reduction of the number of satellite dots and the vibrations of meniscus. Also, with each of the movable members arranged to face the bubble generation area on the upstream side having its free end on the downstream side, the response of the movable member is in good condition, while the movable members can be arranged one to one for the liquid flow paths, respectively. As a result, the space needed for supporting the movable member is minimized to make the liquid discharge head smaller accordingly.

In accordnace with the liquid discharge method of the present invention, it becomes possible to discharge larger liquid droplets, by use of the liquid dishcarge head of the present invention described above, by discharging liquid at stable discharge speeds with each of bubbles created in each of the bubble generation areas where it is created in the bubble generation area on the upstream side after each of them is created in the bubble generation area on the downstream side among each of the bubble generation areas. With this arrangement, it is possible to stabilize the formation of liquid dorplets of different discharge amounts per nozzle.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

In this respect, the term "upstream" and the term "downstream" used in the description of the present invention relates to the direction of the liquid flow toward the discharge ports from the supply source of the liquid by way of each of the bubble generation areas (or each of the movable members) or represented as expressions related to the structural directions.

Also, the terms "downstream side" related to the bubble itself means the downstream side in the flow direction described above or in the structural directions described above, or it means the bubble created in the area on the downstream side of the area center of each heating member. Likewise, the term "upstream side" related to the bubble itself means the upstream side in the flow direction described above or in the structural directions described above, or it means the bubble created in the area on the upstream side of the area center of each heating member.

Also, the expression "essentially in contact" between each of the movable members and the regulating members used for the present invention may be the approaching state where liquid of approximately several $\mu$m exists between each of them or the state where each of the movable members and the regulating members are directly in contact.

BRIEF DESCRIPTION OF THE DRAWINGS

FIG. 13A shows the one having a protection film. FIG. 13B shows the one having no protection film.

DETAILED DESCRIPTION OF THE PREFERRED EMBODIMENTS

Figure 1A:
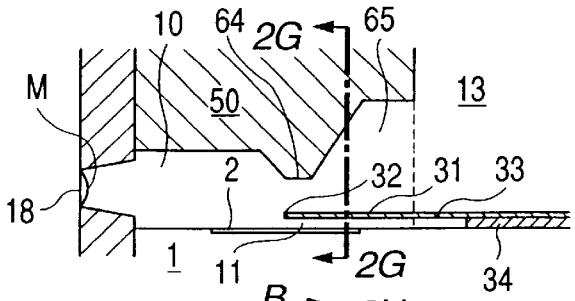
FIGS. 1A, 1B, 1C, 1D, 1E and 1F are cross-sectional views which illustrate the liquid discharge head in accordance with a first embodiment of the present invention, taken along in the liquid flow path direction, and which illustrate the characteristic phenomena in each of the liquid flow paths by dividing the process into those of A to F.

Hereinafter, with reference to the accompanying drawings, the description will be made of the embodiments in accordance with the present invention.

(First Embodiment)

FIGS. 1A to 1F are cross-sectional views which illustrate the liquid discharge head in accordance with a first embodiment of the present invention, taken along in the liquid flow path direction, and which illustrate the characteristic phenomena in the liquid flow paths by dividing the process into those of A to F.

For the liquid discharge head of the present embodiment, the heating members 2 are arranged on a flat and smooth elemental substrate 1 to enable thermal energy to act upon liquid as discharge energy generating elements to discharge liquid. Then, on the elemental substrate 1, liquid flow paths 10 are arranged corresponding to the heating members 2, respectively. The liquid flow paths 10 are communicated with the discharge ports 18, and at the same time, communicated with the common liquid chamber 13 to supply liquid to a plurality of liquid flow paths 10. Thus, each of them receives from the common liquid chamber 13 an amount of liquid that corresponds to that of the liquid which has been discharged from each of the discharge ports 18. A reference mark M designates the meniscus formed by the discharge liquid. The meniscus M is balanced in the vicinity of each discharge port 18 with respect to the inner pressure of the common liquid chamber 13 which is usually negative by means of the capillary force generated by each of the discharge ports 18 and the inner wall of the liquid flow path 10 communicated with it.

The liquid flow paths 10 are structured by bonding the elemental substrate 1 provided with the heating members 2, and the ceiling plate 50, and in the area near the plane at which the heating members 2 and discharge liquid are in contact, the bubble generation area 11 is present where the heating members 2 are rapidly heated to enable the discharge liquid to form bubbles. For each of the liquid flow paths 10 having the bubble generation area 11, respectively, the movable member 31 is arranged so that at least a part thereof is arranged to face the heating member 2. The movable member 31 has its free end 32 on the downstream side toward the discharge port 18, and at the same time, it is supported by the supporting member 34 arranged on the upstream side. Particularly, in accordance with the present embodiment, the free end 32 is arranged on the central portion of the bubble generation area 11 in order to suppress the development of a half of the bubble on the upstream side which exerts influences on the back waves toward the upstream side and the inertia of the liquid. Then, along with the development of the bubble created in the bubble generation area 11, the movable member 31 can be displaced with respect to the supporting member 34. The fulcrum 33 for this displacement is the supporting portion of the movable member 31 by the supporting member 34.

Above the central portion of the bubble generation area 11, the stopper (regulating member) 64 is positioned to regulate the displacement of the movable member 31 within a certain range in order to suppress the development of a half of the bubble on the upstream side. In the flow from the common liquid chamber 13 to the discharge port 18, there is arranged a lower flow path resistance area 65, which presents the relatively lower flow path resistance than the liquid flow path 10, on the upstream side with the stopper 64 as the boundary. The flow path structure in the area 65 is such as to provide no upper wall or to make the flow path sectional area larger, hence making the resistance that liquid receives from the flow path smaller when the liquid moves.

With the structure arranged as above, the head structure is proposed, which is characterized in that unlike the conventional art, each of the liquid flow paths 10 having the bubble generation area 11 becomes an essentially closed space by the contact between the displaced movable member 31 and the stopper 64 with the exception of each of the discharge ports 18.

Now, detailed description will be made of the discharge operation of the liquid discharge head in accordance with the present embodiment.

FIG. 1A shows the state before energy, such as electric energy, is applied to the heating member 2, which illustrates the state before the heating member generates heat. What is important here is that the movable member 31 is positioned to face a half of the bubble on the upstream side for each of the bubbles created by the heating of the heating member 2, and the stopper 64 that regulates the displacement of the movable member 31 is arranged above the central portion of the bubble generation area 11. In other words, with the structure of the flow paths and arrangement position of each of the movable members, a half of the bubble on the upstream side is held down to the movable member 31.

Figure 1B:
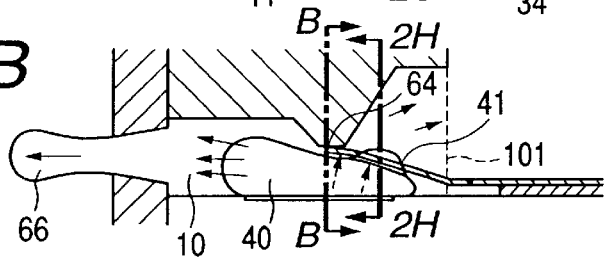

FIG. 1B shows the state in which a part of the liquid filled in the bubble generation area 11 is heated by the heating member 2 so that the bubble 40 is developed almost to the maximum following the film boiling. At this juncture, the pressure waves generated by the creation of the bubble 40 are propagated in the liquid flow path 10, and along with it, the liquid moves to the downstream side and the upstream side with the central area of the bubble generation area as its boundary. Then, on the upstream side, the movable member 31 is displaced by the flow of liquid along with the development of the bubble 40. On the downstream side, the discharged liquid droplet 66 is being discharged from the discharge port 18. Here, the movement of liquid on the upstream side, that is, toward the common liquid chamber 13, becomes a greater flow by the presence of the lower flow path resistance area 65 where the liquid can move easily because of the lower resistance of the flow path than the downstream side with respect to the movement of the liquid. However, when the movable member 31 is displaced as close as to the vicinity of the stopper 64 or to be in contact with the stopper, any further displacement is regulated. Then, the movement of the liquid toward the upstream is restricted greatly, hence the development of the bubble 40 to the upstream side is restricted accordingly by the movable member 31. However, since the shifting force of liquid in the upstream direction is great, the movable member 31 receives the stress in the form that it is pulled in the upstream direction. Further, a part of the bubble 40 whose development is restricted by the movable member 31 is extruded to the upper surface side of the movable member 31 through the slight gaps between the both side walls that form the liquid flow path 10 and the side portions of the movable member 31. The bubble thus extruded is termed as the "extruded bubble 41" in the specification hereof.

The structure is arranged so that in this state, the entire configuration of the liquid flow path toward the discharge port side is made gradually wider from the upstream side to the downstream side with respect to the movable member 31.

Figure 19:
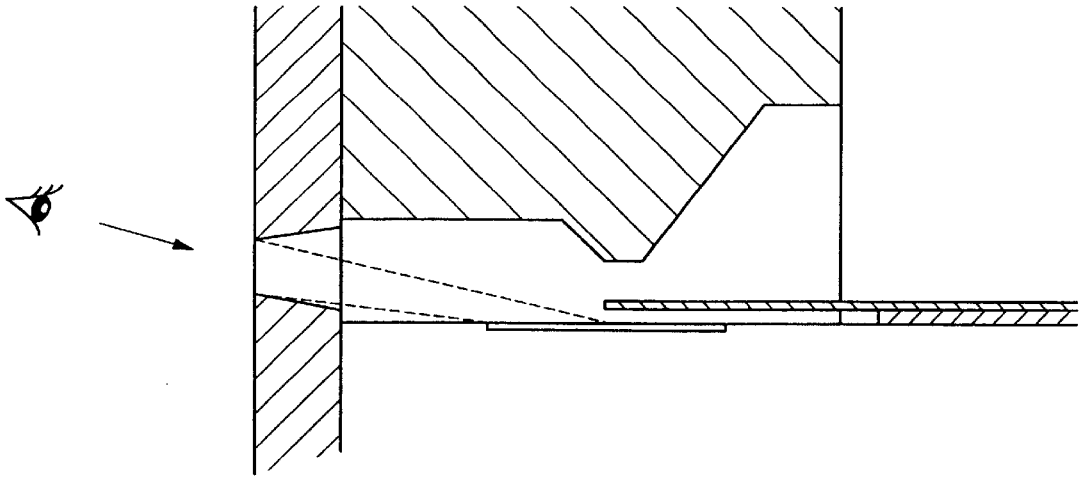
FIG. 19 is a cross-sectional view which shows the flow path for the illustration of the "linearly communicated state" of the liquid discharge head of the present invention.

In accordance with the present invention, the portion of the bubble 40 on the discharge port side, and the discharge port maintains the "linearly communicated state" where the straight flow path structure is kept between them with respect to the liquid flow as shown in FIG. 19. More preferably, it is desirable to attain the ideal condition in which the propagating direction of the pressure waves generated at the time of the bubble development, the direction of liquid flow that follows it, and the direction of discharges are in agreement on the straight line so as to stabilize the discharge direction of the discharge liquid droplet 66, the discharge velocity thereof, and other conditions at an extremely high level. For the present invention, it should be good enough as one of the definitions to attain this ideal condition or approximate the structure to be in the ideal condition if only the structure is arranged to directly connect on the straight line the discharge port 18 with the heating member 2 (particularly, with the heating member on the discharge port side (on the downstream side) which is more influential on bubbling). The condition thus obtained can be observed from the outside of the discharge port if no liquid is present in the flow path. Particularly, the downstream side of the heating member is made observable in this condition. Also, among such structures, it is more preferable from the viewpoint of the stabilization of discharge direction to arrange the structure so that the extended line of the discharge axis of the discharge port intersects the center of the heating member.

On the other hand, as described earlier, the displacement of the movable member 31 is regulated by the presence of the stopper 64 as to the portion of the bubble 40 on the upstream side. Therefore, this portion of the bubble is made smaller in size just to be in the state where it stays to charge the stress by the movable member 31 which is bent to be extruded toward the upstream side by the inertia of the liquid flow to the upstream side. For this portion as a whole, the amount which enters the area on the upstream side by means of the stopper, the liquid flow path partition walls 101, the movable member 31, and the fulcrum 33 is made almost zero.

In this respect, the convex bend should amount within a minute range of approximately 20 micron at the maximum.

Figure 6:
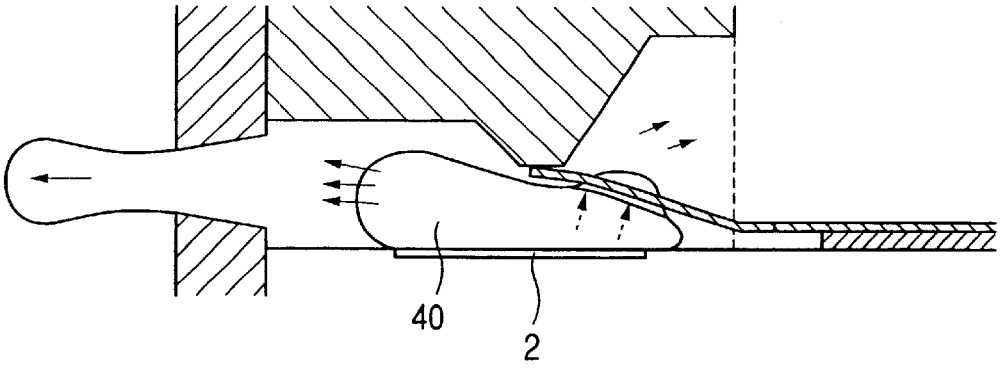
FIG. 6 is a cross-sectional view which shows one embodiment of the liquid discharge head represented in FIGS. 1A to 1F, taken along in the liquid flow path direction, illustrating the condition in which the liquid flow is not blocked in the space essentially closed by means of the movable member and regulating member with the bubble in the maximum bubbling state.

Also, in this case, the liquid in the space formed by the contact between the regulating member and the movable member is in contact with the movable member at the time of its maximum bubbling, and continued with the liquid on the downstream side of the bubble generation area in the space. More specifically, the structure is arranged so that the bubble does not cover the essentially contacted portion of the movable member at the time of its maximum bubbling. With the structure thus arranged, it becomes possible to smooth the liquid flow that flows in when the movable member is released from the aforesaid contacted condition, and the refilling is effectuated rapidly and stably. Also, as shown in FIG. 6, it is more preferable to allow the maximum bubble 4*a* to be in the state where it does not block the liquid flow in the space so that it can be continued with the liquid on the upstream side of the heating member 2 in the space. Here, it is possible to attain the formation of this structure by setting the minimum flow path distance (height) formed by the contact between the regulating member and the movable member at 40 micron or more or by observing the bubble formation by the degree in which the liquid flow resistance on the discharge port side is made smaller than the minimum flow path distance.

In this way, the liquid flow to the upstream side is largely regulated to prevent the liquid cross talks with the adjacent nozzles and the reversed liquid flow in the supply system which may impede the higher refilling to be described later, and to prevent pressure vibrations as well.

In accordance with the present embodiment, the liquid flow is disturbed on the upper surface of the movable member 31 to draw the bubble around the upper surface of the movable member 31, but the upper surfaces of the flow path ceiling and the movable member 31, which form the lower flow path resistance area 65, are flat, respectively, and there is a gap apart from them. Therefore, there is no possibility that the bubble which has been drawn around through the sides of the movable member is not allowed to be one body. With this condition together with the larger shifting force of liquid in the upstream direction, the movable member 31 receives the stress in the form that it is pulled in the upstream direction as described earlier.

Figure 1C:
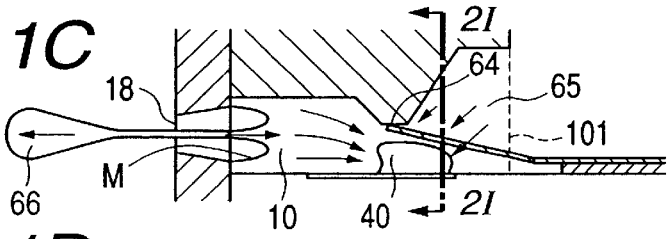

FIG. 1C shows the state where the contraction of the bubble 40 begins when the negative pressure in the interior of the bubble has overcome the shifting of the liquid to the downstream side in the liquid flow path subsequent to the film boiling described earlier. At this juncture, the force of the liquid which is exerted by the development of the bubble still remains largely on the upstream side. Therefore, the movable member 31 is still in contact with the stopper 64 for a specific period after the contraction of the bubble 40 has begun, and the most of the contracted bubble 40 exerts the shifting force of liquid in the upstream direction from the discharge port 18. In the state shown in FIG. 1B, the movable member 31 is in the condition to charge the extrusive stress to cause it to be bent to the upstream side. Then, the movable member itself exerts the force to make it concave in the upstream direction by drawing the liquid flow from the side where the stress is released, that is, the upstream side as shown in FIG. 1C. As a result, at a certain point, the force that draws the movable member back in the direction from the upstream side overcomes the shifting force of liquid on the upstream side as described earlier, thus enabling the flow to begin, although slightly, from the upstream side to the discharge port side. Then, the bending of the movable member 31 is reduced to enable it to begin the concave displacement in the upstream direction. In other words, the imbalanced condition takes place for the bubble 40 on the upstream side and the downstream side, which creates one-way flow of the liquid temporarily as a whole in the direction towards the discharge port in the liquid flow path.

At the timing immediately after that, the displaced movable member 31 is still in contact with the stopper 64 in the interior of the flow path as a whole. Therefore, the liquid flow path 10 having the bubble generation area 11 in it is essentially in the closed space with the exception of the discharge port 18. Then, the energy exerted by the contraction of the bubble 40 is allowed to act strongly as a force in terms of the total balance thereof, and to enable the liquid in the vicinity of the discharge port 18 to shift in the upstream direction. Consequently, the meniscus M is largely drawn back from the discharge port 18 to the interior of the liquid flow path 10 to quickly cut off the liquid column which is connected with the discharged liquid droplet 66. Then, as shown in FIG. 1D, the amount of the resultant satellites (sub-droplets) 67 becomes smaller, which remains on the outer side of the discharge port 18.

Figure 1D:
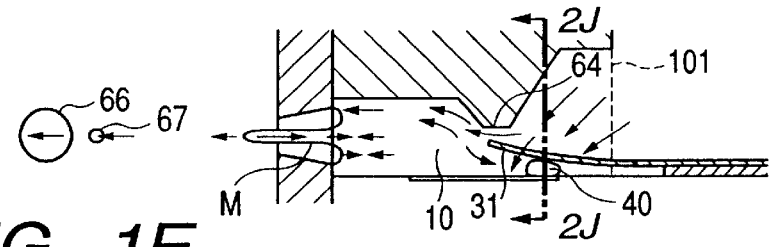

FIG. 1D shows the state where the meniscus M and the discharged liquid droplet 66 are cut off when the bubble disappearing process is almost completed. In the lower flow path resistance area 65, the movable member 31 begins to be displaced downward. Also the flow begins to run in the downstream direction in the lower flow path resistance area 65 following such displacement of the movable member due to the resiliency of the movable member 31 against the shifting force of liquid in the upstream direction, and the contracting force exerted by the disappearing of bubble 40 as well. Then, the close approach or the contact between the movable member 31 and the stopper 64 begins to be released. Along with this, the flow in the downstream direction in the lower flow path resistance area 65, which has a smaller flow path resistance, becomes a larger flow rapidly, and flows into the liquid flow path 10 through the stopper 64 portion. As a result, the flow that causes the meniscus M to be drawn into the interior of the liquid flow path 10 is reduced abruptly. The meniscus M begins to return in a comparatively slow speed to the position at which the bubbling is originated, while drawing the liquid column, which remains outside the discharge port 18 or which is made convex in the discharge port 18 direction, without cutting it off as much as possible. Particularly, by the returning flow for the meniscus M and the refilling flow from the upstream, which are joined together, the area having almost zero flow rate is formed between the discharge port 18 and the heating member 2, hence making the settling performance of meniscus better. This performance depends on the viscosity and the surface tension of ink, but in accordance with the present invention, it becomes possible to drastically reduce the satellites which are separated from the liquid column to degrade the quality of images when adhering to a printed object or to produce adverse effects on the discharge direction that may cause the disabled discharge when adhering to the circumference of the orifices.

Also, the meniscus M itself begins to be restored before it is largely drawn into the interior of liquid flow path. Therefore, the restoration is completed within a short period of time despite the speed of liquid shift itself which is not very high. As a result, the overshooting of the meniscus, that is, the amount thereof which is extruded outside the discharge port 18 without stopping at the discharge port 18, is reduced. Then, in an extremely short period of time, it becomes possible to eliminate the phenomenon of the attenuating vibrations having its settling point at the discharge port 18 from which the overshooting is made. This phenomenon of the attenuating vibrations also produces adverse effects on the print quality. With the quicker elimination of this phenomenon, the present invention is devised to contribute significantly to the implementation of the stabilized higher printing.

Further, since the essentially closed condition is dominant on the upstream side with respect to the linearly communicated state on the downstream side as to the behavior the bubble and liquid on the heating member in the bubble disappearing process, an extremely imbalanced status may take place. In other words, the bubble disappearing point of the bubble shifts greatly in the fulcrum direction of the movable member. Then, the liquid flow to follow is also caused to shift at a high speed on the surface of the heating member in the upstream direction (see FIGS. 5A to 5F).

This flow promotes to refresh the stagnation or pool of the liquid which may cause bubbling to be unstable on the surface of the heating member, and at the same time, improves the uniform surface condition to enhance the bubbling stability. Further, if the bubble disappearing point shifts from the heating member to the fulcrum point side, it becomes possible that the damage of the cavitation is not caused directly to the heating member. Then, the life of the heating member is improved significantly.

Further, since the flow that enables the bubble disappearing point to shift is allowed to flow out to the liquid flow path 10 and the common liquid chamber 13 from the sides of the movable member 31, the refreshing is made more effectively.

Also, as shown in FIG. 1D, the current, which flows into the liquid flow path 10 through the portion between the movable member 31 and the stopper 64 as described earlier, makes the flow rate faster on the wall face of the ceiling plate 50 side. As a result, the residual bubble, such as minute bubbles on this portion, becomes extremely small, which contributes to stabilizing discharges significantly.

On the other hand, among those satellites 67 residing immediately after the discharged liquid droplet 66, there are some which are extremely close to the discharged liquid droplet due to the rapid meniscus drawing as shown in FIG. 1C. Here, the so-called slip stream phenomenon is created, which causes the satellite closely following the discharged liquid droplet to be attracted to it due to the eddy current occurring behind the flying discharged liquid droplet 66.

Now, this phenomenon will be described precisely. With the conventional liquid discharge head, the liquid droplet is not in the spherical form the moment liquid is discharged from the discharge port of the liquid discharge head. The liquid droplet is discharged almost in the form of a liquid column having its spherical part on the leading end thereof. Thus, the trailing portion is tensioned both by the main droplet and the meniscus, and when it is cut off from the meniscus, the satellite dots are formed with the trailing portion. Here, it is known that the satellites fly to a recording medium together with the main droplet. The satellites fly behind the main droplet, and also, the satellites are drawn by the meniscus. Therefore, the discharge velocity thereof is slower to that extent to cause its impacted position to be deviated from that of the main droplet. This inevitably degrades the quality of prints. In accordance with the liquid discharge head of the present invention, the force that draws back the meniscus is much greater than the conventional liquid discharge head as described earlier. Thus, the drawing force given to the trailing portion is stronger after the main droplet has been discharged. The force with which the trailing portion is cut from the meniscus becomes stronger accordingly to make its timing faster. As a result, the satellite dots which are formed from the trailing portion become much smaller, and the distance between the main droplet and satellite dots is also made shorter. Further, since the trailing portion is not drawn by meniscus continuously for a longer period, the discharge velocity does not become slower.

Hence, the satellites 67 are drawn to the main droplet by the slip stream phenomenon occurring behind the discharged liquid droplet 66.

Figure 1E:
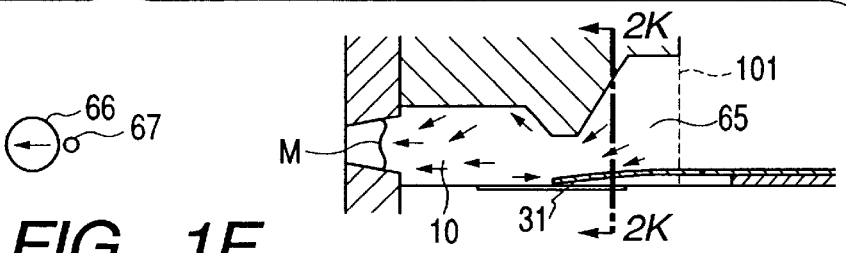

FIG. 1E shows the condition where the state illustrated in FIG. 1D has further advanced. Here, the satellite 67 is still closer to the discharged liquid droplet 66. It is drawn to the discharge liquid droplet simultaneously. Then, the drawing force exerted by the slip stream phenomenon becomes greater accordingly. On the other hand, the liquid shift from the upstream side in the direction toward the discharge port 18 is displaced downward more than the initial position due to the completion of the bubble disappearing process of the bubble 40, as well as due to the overshot displacement of the movable member 31. Then, the resultant phenomenon takes place to draw liquid from the upstream side and push out liquid in the direction toward the discharge port 18. Further, by the expansion of the sectional area of the liquid flow path due to the presence of the stopper 64, the liquid flow is increased in the direction toward the discharge port 18 to enhance the restoring speed of the meniscus M to the discharge port 18. In this manner, the refilling characteristic of the present embodiment is drastically improved.

Figure 5A:
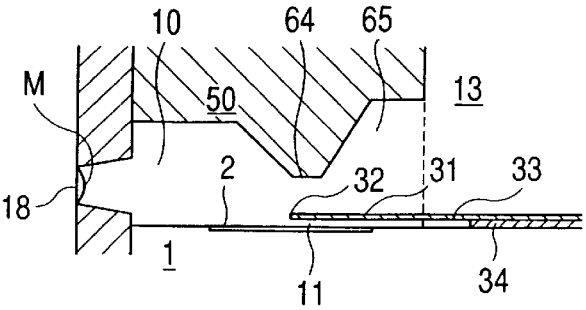
FIGS. 5A, 5B, 5C, 5D, 5E and 5F are cross-sectional views which illustrate the liquid discharge head represented in FIGS. 1A to 1F, taken along in the liquid flow path direction, and which illustrate the characteristic phenomena in each of the liquid flow paths by dividing the process into those of A to F.
Figure 5B:
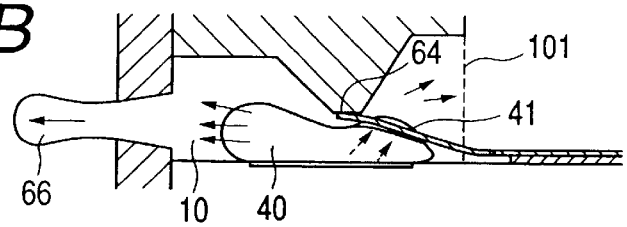
Figure 5C:
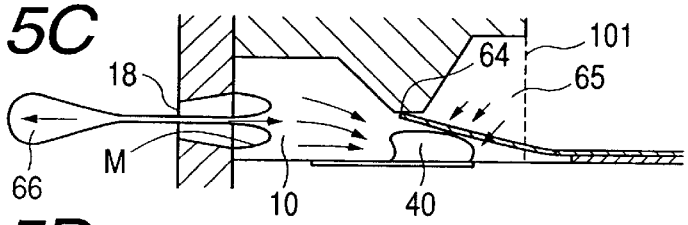
Figure 5D:
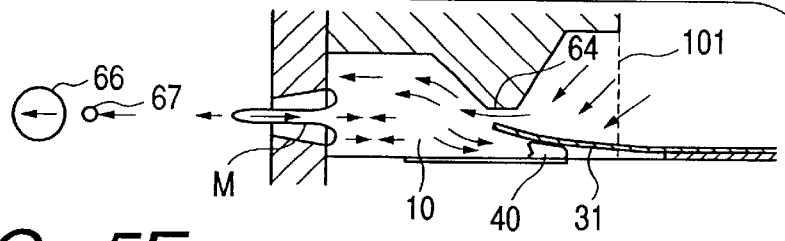
Figure 5E:
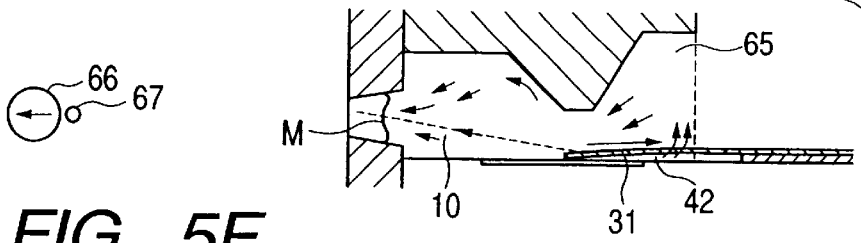
Figure 5F:
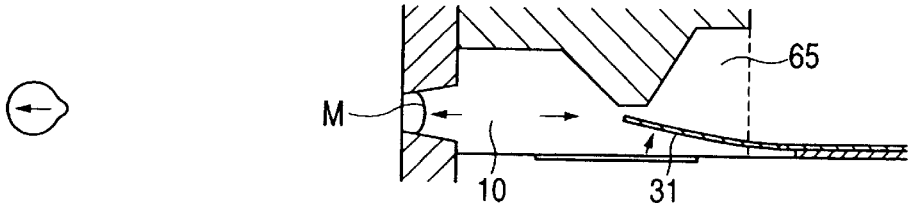

As shown in FIG. 5E, the point of bubble extinction in the bubble disappearing process, that is, the so-called cavitation point 42, is in the region on the lower side of the movable member 31 in accordance with the present invention. Further, the movable member 31 is also displaced downward when the cavitation occurs, and the movable member is positioned to reside on the line (indicated by dotted line in FIG. 5E) which connects the cavitation point 42 and the discharge port 18 on the straight line. As a result, the shock waves exerted by the cavitation are not propagated directly to the discharge port. Thus, the spreading of liquid droplets from the meniscus, the so-called "microdots", caused by the cavitation is reduced or eliminated. This is because the shock waves of the cavitation are rebound or its energy is absorbed by the movable member itself when the shock waves reach the movable member 31. The vibrations absorbed by the movable member are propagated in the fulcrum direction and attenuated in its process. Consequently, there is almost no adverse effect that may be produced on discharges.

Also, when the cavitation occurs at the time of bubble extinction, the movable member 31 is displaced downward to separate the bubble disappearing point and the discharge port 18. Therefore, the shock waves of the cavitation is not propagated directly to the discharge port 18, and most of them are absorbed by the movable member 31. Thus, the creation of the ultrafine droplets, called "microdots", from the meniscus is almost eliminated when the shock waves of the cavitation reach the meniscus. The occurrence of the phenomenon that the image quality is degraded by the adhesion of the microdots to the printed object or that the discharges are made unstable due to the adhesion thereof to the vicinity of the discharge port 18 is drastically reduced.

Further, the point where the cavitation occurs due to bubble disappearing is allowed to shift to the fulcrum 33 side by the presence of the movable member 31. As a result, damages to the heating member 2 become smaller. Also, the overviscose ink is compulsorily moved from the closed area between the movable member 31 and the heating member 2 for its removal, hence enhancing the discharge durability. It becomes possible to reduce the adhesion of the burnt ink on the heating member due to this phenomenon in this area, thus improving the stability of discharges.

Figure 1F:
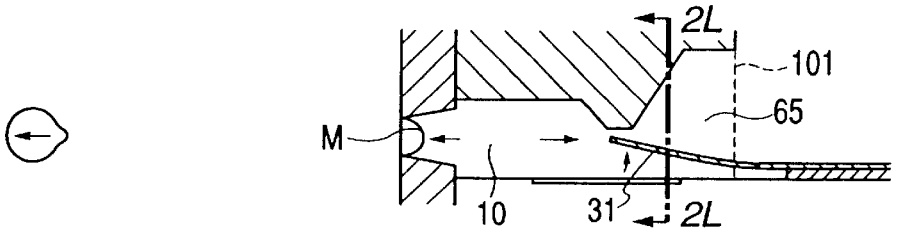
Figure 2A:
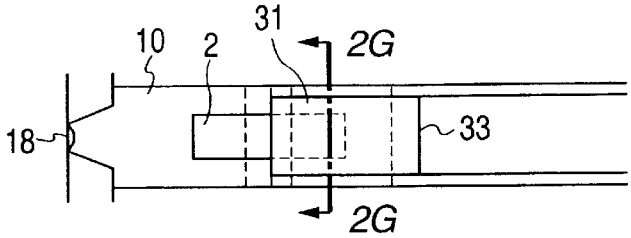
FIGS. 2A, 2B, 2C, 2D, 2E and 2F are perspective plan views which illustrate each of the processes A to F shown in FIGS. 1A to 1F, observed through the ceiling plate in the substrate direction from the ceiling plate side, respectively.
Figure 2G:
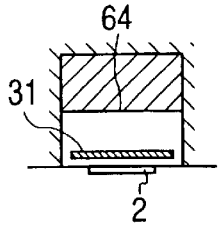
FIGS. 2G, 2H, 2I, 2J, 2K and 2L are cross-sectional views observed from the upstream side, taken along lines 2G—2G to 2L—2L.
Figure 2B:
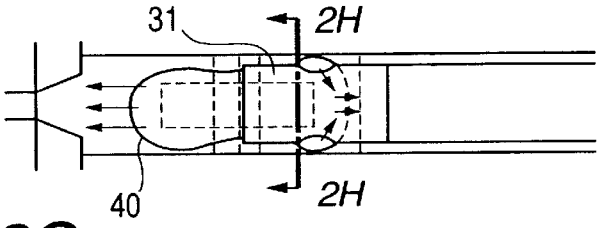
Figure 2H:
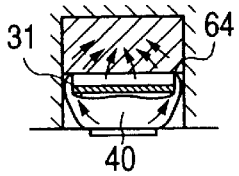
Figure 2C:
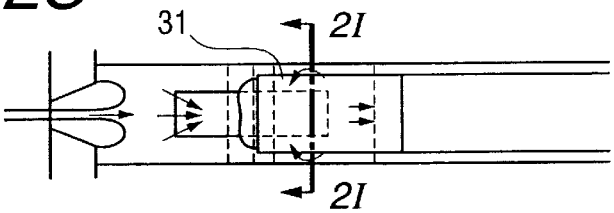
Figure 2I:
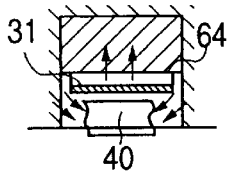
Figure 2D:
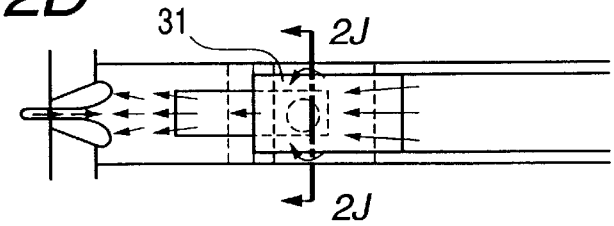
Figure 2J:
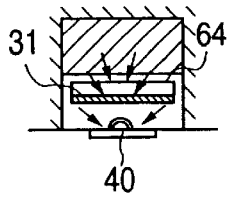
Figure 2E:
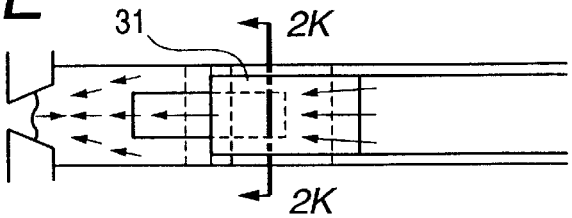
Figure 2K:
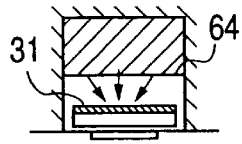
Figure 2F:
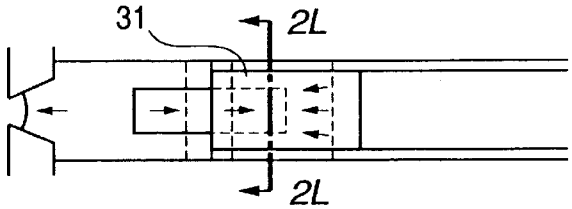
Figure 2L:
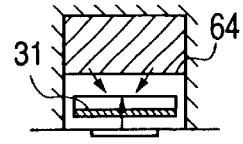

FIG. 1F shows the condition in which the state illustrated in FIG. 1E has further advanced, and the satellite 67 is caught into the discharged liquid droplet 66. The combined body of the discharged liquid droplet 66 and the satellite 67 is not necessarily the phenomenon that should occur under any circumstances per discharge for any other embodiments. Depending on conditions, such phenomenon takes place or it does not take place at all. However, by eliminating the satellites or at least by reducing the amount of satellites, there is almost no deviation between the impact positions of the main droplet and the satellite dots on the recording medium so as to minimize the adverse effect that may be produced on the quality of prints. In other words, the sharpness of printed images is enhanced to obtain the quality of prints in a better condition, and at the same time, it becomes possible to avoid making them mists and reduce the occurrence of the damage that the mist thus created may stain the printing medium or the interior of the recording apparatus.

In the meantime, the movable member 31 is again displaced in the direction toward the stopper 64 due to the reaction of its overshooting. This displacement is suspended at the initial position lastly, because it is settled by the attenuating vibrations determined by the configuration of the movable member 31, the Young's modulus, the viscosity of liquid in the liquid flow path, and the gravity.

With the upward displacement of the movable member 31, the flow of liquid is controlled in the direction toward the discharge port 18 from the common liquid chamber 13 side. Then, the movement of the meniscus M is quickly settled on the circumference of the discharge port. As a result, it becomes possible to significantly reduce the factors that may degrade the quality of prints due to the overshooting phenomenon of the meniscus or the like that may unstabilize the condition of discharges.

Now, the description will be made more of the effects characteristic of the present embodiment.

Figure 3:
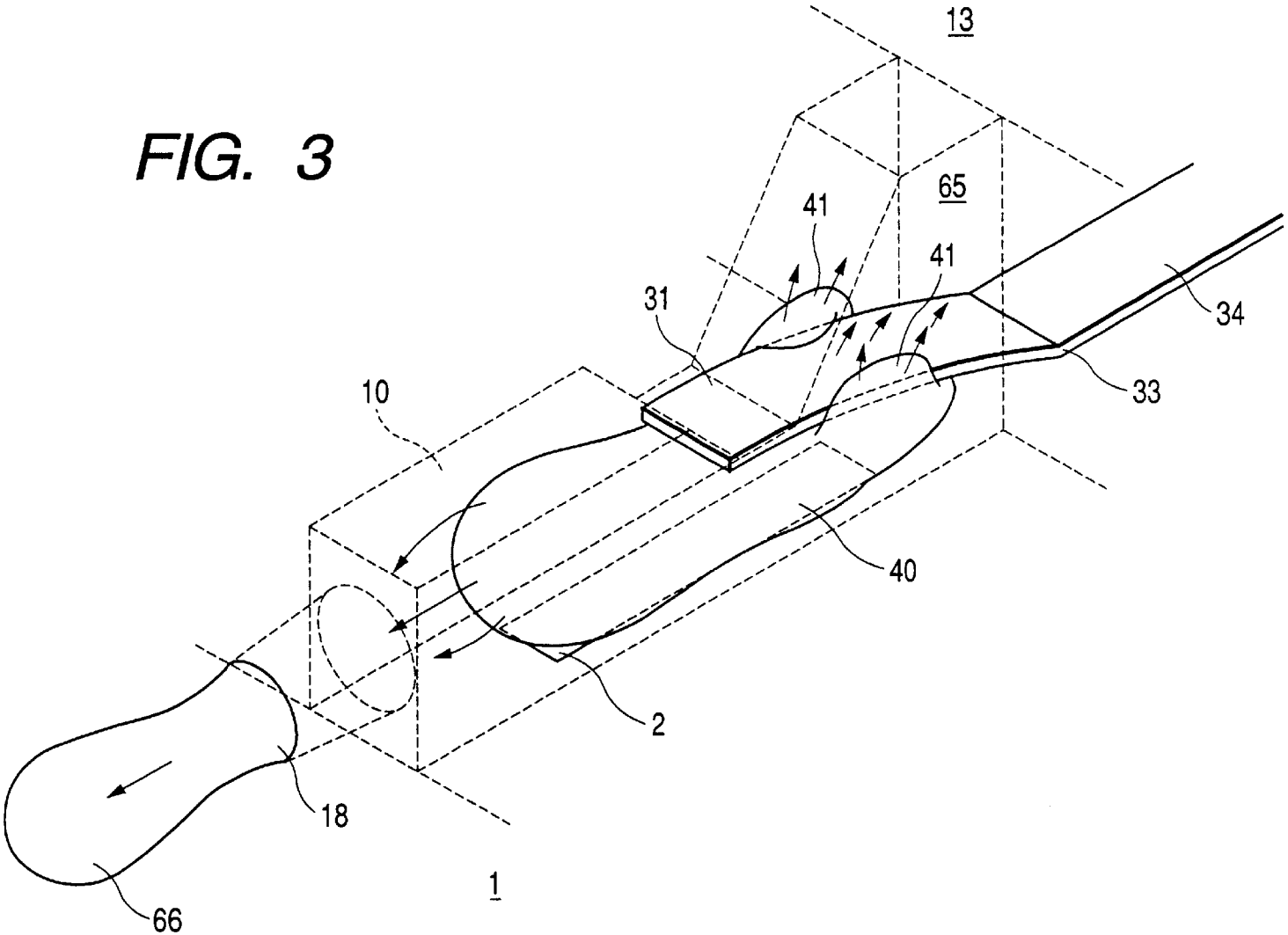
FIG. 3 is a perspective view which shows a part of the head represented in FIG. 1B and FIG. 2B.
Figure 4:
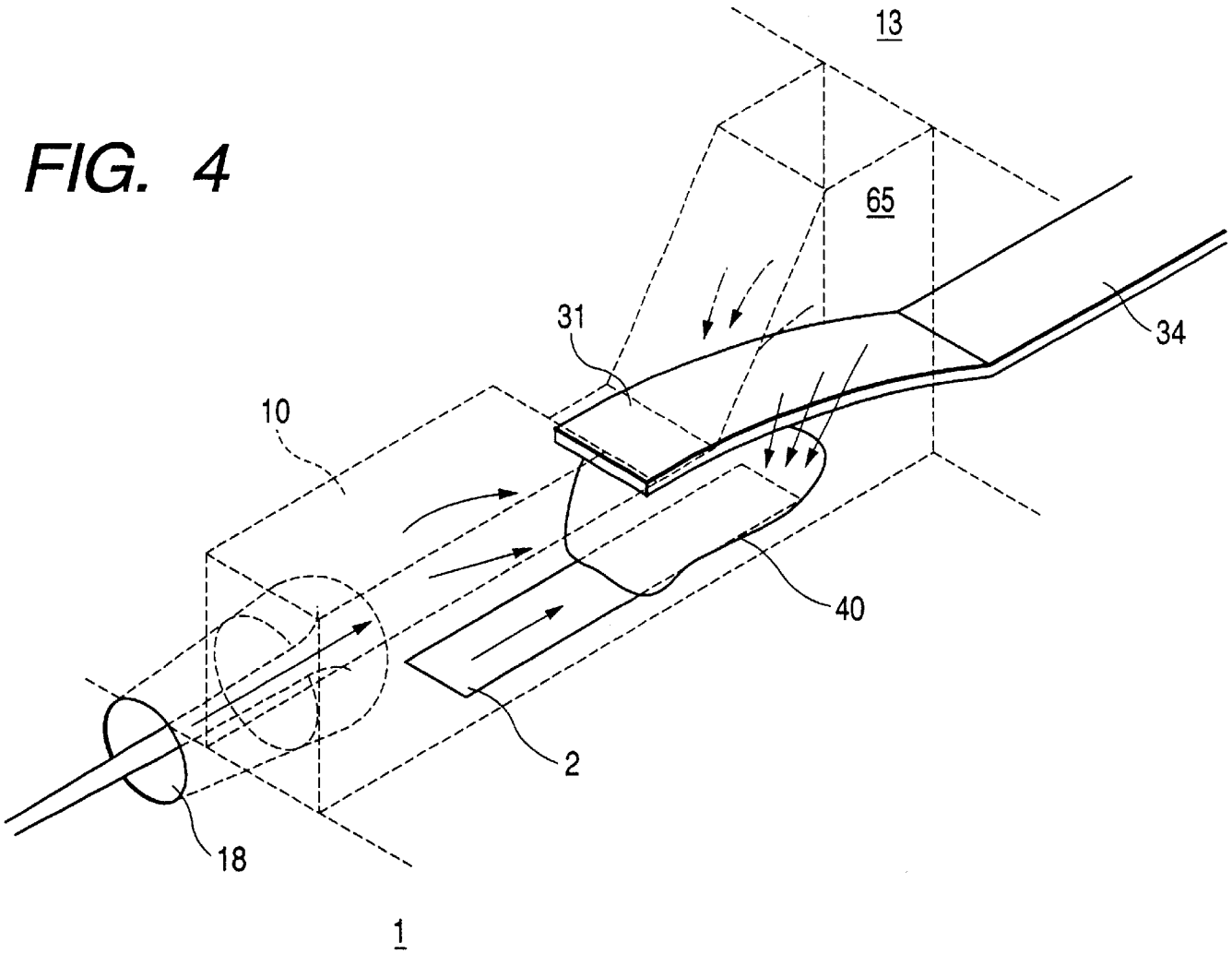
FIG. 4 is a perspective view which shows a part of the head represented in FIG. 1C and FIG. 2C.

FIGS. 2A to 2F are perspective plan views which illustrate each of the processes A to F shown in FIGS. 1A to 1F, observed through the ceiling plate in the substrate direction from the ceiling plate side, respectively; and FIGS. 2G to 2L are cross-sectional views, taken along lines 2G—2G to 2L—2L in FIGS. 1A to 1F, and observed from the upstream side. FIG. 3 is a perspective view which shows a part of the head represented in FIG. 1B and FIG. 2B. FIG. 4 is a perspective view which shows a part of the head represented in FIG. 1C and FIG. 2C. In this respect, the heating member 2, the movable member 31, and the bubble 40 are represented opaquely, and liquid is represented transparently.

For the present embodiment, FIGS. 2A to 2L illustrate the state where the bubble is held by the movable member at the time of bubble development. As shown in FIGS. 2A to 2L, there are slight clearances between both side faces of the wall that constitutes the liquid flow path 10 and both side portions of the movable member 31, hence making it possible to displace the movable member 31 smoothly. Further, in the development process of bubble by means of the heating member 2, the bubble 40 displaces the movable member 31. And the bubble is allowed to be extruded to the upper surface side of the movable member 31 through the clearances, and enters the lower flow path resistance area 65 slightly (see FIG. 2B and FIG. 3). The extruded bubble 41 enters this area around the back of the movable member 31 (the surface opposite to the bubble generation area 11) so as to suppress the deflection of the movable member 31 for the stabilization of the discharge characteristics.

Further, when the bubble disappearing of the bubble 40 begins, the extruded bubble 41 effectuates the liquid flow from the upstream side of the movable member by the presence of the clearances when the extruded bubble is drawn from the lower flow path resistance area 65 into the bubble generation area 11 through the clearances. And as shown in FIG. 4, the bubble 40 is rapidly disappeared together with the meniscus drawn from the discharge port side 18 at a high speed as described earlier. At this juncture, the liquid flow path 10 having the bubble generation area 11 in it forms the essentially closed space by the contact between the displaced movable member 31 and the stopper 64 with the exception of the discharge port 18, hence creating the so-called "well" which is locally encircled portion in the space having liquid filled in it. In this "well", the current occurs at once from the clearances and the discharge port 18 side along with the contraction of the bubble 40. As a result, the accumulation of bubbles and heat in the vicinity of the heating member 2 is eliminated even in the system where no liquid circulating system is arranged, thus making it possible to obtain the extremely stabilized discharge characteristics. In this respect, the structure is arranged for the present embodiment so that the bubble is extruded from the clearances when the bubble is developed. However, it is not necessarily to limit the extrusion of bubble to this arrangement if the bubble can be held by the movable member when it is developed, and the bubble can flow in the bubble generation area through the clearances together with the liquid on the upstream side of the movable member when the bubble is disappeared. Also, it is desirable to set the width of each clearance at 8 to 13 $\mu$m for the attainment of this arrangement.

Further, in the bubble disappearing process of the bubble 40, the extruded bubble 41 promotes the liquid flow from the lower flow path resistance area 65 to the bubble generation area 11, and together with the high speed drawing of the meniscus from the discharge port 18 side as described earlier, the bubble disappearing is completed quickly. Particularly, by the liquid flow created by the provision of the extruded bubble 41, there is almost no possibility that bubbles are allowed to reside on the corners of the movable member 31 and the liquid flow path 10.

With the liquid discharge head structured as described above, the discharged liquid droplet is almost in the form of the liquid column having the spherical portion at the leading end thereof the moment it is discharged from the discharge port by the creation of the bubble. This condition is the same as that of the head which is structured conventionally. However, in accordance with the present invention, the removable member is displaced by the development process of the bubble, and then, when the movable member thus displaced is in contact with the regulating member, an essentially closed space is formed for the liquid flow path having the bubble generation area in it with the exception of the discharge port. As a result, if the bubble is disappeared in this state, the closed space is kept as it is until when the movable member is caused to part from the regulating member due to bubble disappearing. Thus, most of the bubble disappearing energy of the bubble is allowed to act upon shifting the liquid in the vicinity of the discharge port in the upstream direction. Thus, immediately after the beginning of the bubble disappearing, the meniscus is rapidly drawn into the interior of the liquid flow path, and then, with the strong force thus exerted by the meniscus, it becomes possible to quickly cut off the trailing portion which forms the liquid column by being connected with the discharged liquid droplet outside the discharge port. In this manner, the satellite dots which are each formed by the trailing portion are made smaller, hence contributing to the enhancement of the quality of prints significantly.

Further, since the trailing portion is not continuously drawn by the meniscus for a long time, the discharge velocity is not affected to become slower. Also, the distance between the discharged liquid droplet and each of the satellite dots is made shorter so that the satellite is drawn closer to the discharged liquid droplet by the so-called slip stream phenomenon which takes place behind the flying droplet. As a result, the jointed body of the discharged liquid droplet and the satellite dots may be formed to make it possible to provide the liquid discharge head which may create almost no satellite dots.

Moreover, the present invention is characterized in that the movable member is arranged to suppress only the bubble which is developed in the upstream direction with respect to the liquid flow toward the discharge port of the aforesaid head. It is more preferable to position the free end of the movable member essentially on the central portion of the bubble generation area. With the structure thus arranged, it becomes possible to suppress the back waves to the upstream side and the inertia of the liquid by the development of the bubble, which is not directly related to the liquid discharges. It becomes possible to direct the development component of the bubble on the downstream side easily in the direction toward the discharge port. Further, the present invention is characterized in that for the aforesaid head, the flow path resistance of the liquid flow path on the side opposite to the discharge port is made lower with the aforesaid regulating member as the boundary. With the structure thus arranged, the liquid shifting in the upstream direction by the development of the bubble becomes a greater flow by the presence of the liquid flow path whose flow path resistance is made lower. As a result, when the displaced movable member is in contact with the regulating member, the movable member receives the stress which tends to draw it in the upstream direction. Therefore, if the bubble disappearing begins in this state, the shifting force of liquid in the upstream direction by the development of the bubble still remains greatly to make it possible to keep the aforesaid closed space during a specific period until the resiliency of the movable member overcomes this force exerted by the liquid shift. In other words, with the structure thus arranged, it becomes more reliable to perform the high speed meniscus drawing. Also, when the bubble disappearing process advances to enable the resiliency of the movable member to overcome the force of liquid shift in the upstream direction by the development of the bubble, the movable member is displaced downward in order to be restored to the initial state, hence creating the flow in the downstream direction along with this even in the lower flow path resistance area. Now that the flow in the downstream direction in the lower flow path resistance area has a smaller flow path resistance, this flow becomes a greater current rapidly and flows into the liquid flow path through the regulating member. As a result, by the flow shift in the downstream direction toward the discharge port, the meniscus drawing is abruptly suspended to settle the vibrations of the meniscus very quickly.

(Second Embodiment)

Now, with reference to the accompanying drawings, the description will be made of a second embodiment in accordance with the present invention.

FIGS. 7A to 7F and FIGS. 8A to 8E are cross-sectional views which illustrate the liquid discharge head in accordance with one embodiment of the present invention, taken along in the liquid flow path direction, and which illustrate the characteristic phenomena in each of the liquid flow paths by dividing the process into those of A to F and A to E when the heating member on the upstream side or on the downstream side is driven, respectively. FIGS. 7A to 7F illustrate the characteristic phenomena when each of the heating member on the upstream side is driven. FIGS. 8A to 8E illustrate the characteristic phenomena when each of the heating members on the downstream side is driven.

For the liquid discharge head of the present embodiment, the heating members 2 and 3 are arranged on a flat and smooth elemental substrate 1 to enable thermal energy to act upon liquid as discharge energy generating elements to discharge liquid. Then, on the elemental substrate 1, liquid flow paths 10 are arranged corresponding to the heating members 2 and 3, respectively. Each of the heating members 2 and 3 are arranged in the longitudinal direction for one liquid flow path 10, respectively. Then, each of them can generate heat individually. The heating member 3 on the downstream side has a smaller area than the heating member 2 on the upstream side, which is aimed to discharge each liquid droplet having a smaller discharge amount. With these two heating members 2 and 3 which can be driven appropriately, it is made possible to discharge liquid droplets of different discharge amounts, respectively.

The liquid flow paths 10 are communicated with the discharge ports 18, and at the same time, communicated with the common liquid chamber 13 to supply liquid to a plurality of liquid flow paths 10. Thus, each of them receives from the common liquid chamber 13 an amount of liquid that corresponds to that of the liquid which has been discharged from each of the discharge ports 18. A reference mark M designates the meniscus formed by the discharged liquid. The meniscus M is balanced in the vicinity of each discharge port 18 with respect to the inner pressure of the common liquid chamber 13 which is usually negative by means of the capillary force generated by each of the discharge ports 18 and the inner wall of the liquid flow path 10 communicated with it.

The liquid flow paths 10 are structured by bonding the elemental substrate 1 provided with the heating members 2 and 3, and the ceiling plate 50, and in the area near the plane at which the heating members 2 and 3, and discharge liquid are in contact, the bubble generation areas 11 and 12 ares present where the heating members 2 and 3 are rapidly heated to enable the discharge liquid to form bubbles. For each of the liquid flow paths 10, the movable member 31 is arranged so that at least a part thereof is arranged to face the bubble generation area 11 on the upstream side, and that it is made displaceable along with the development of bubble created by the heating of the heating members 2 and 3. The movable member 31 has its free end 32 on the downstream side toward the discharge port 18, and at the same time, it is supported by the supporting member 34 on the upstream side. Particularly, in accordance with the present embodiment, the free end 32 is arranged on the central portion of the bubble generation area 11 in order to suppress the development of a half of the bubble on the upstream side which exerts influences on the back waves toward the upstream side and the inertia of the liquid. Then, the fulcrum 33 at which the movable member 31 is made displaceable functions as the supporting portion of the supporting member 34 for the movable member 31.

Above the central portion of the bubble generation area 11, the stopper (regulating member) 64 is positioned to regulate the displacement of the movable member 31 within a certain range in order to suppress the development of a half of the bubble created by the heating member 2 on the upstream side. In the flow from the common liquid chamber 13 to the discharge port 18, there is arranged a lower flow path resistance area 65, which presents the relatively lower flow path resistance than the liquid flow path 10, on the upstream side with the stopper 64 as the boundary. The flow path structure in the area 65 is arranged so as not to provide any upper wall or so as to make the flow path sectional area larger, thus making the resistance that liquid receives from the flow path smaller when the liquid moves.

With the structure arranged as above, it has been proposed to form the head structure which is characterized in that unlike the conventional art, each of the liquid flow paths 10 having the bubble generation areas 11 and 12 becomes an essentially closed space by the contact between the displaced movable member 31 and the stopper 64 with the exception of each of the discharge ports 18.

Now, detailed description will be made of the discharge operation of the liquid discharge head in accordance with the present embodiment. As described above, the liquid discharge head of the present embodiment is provided with two heating members 2 and 3 for one liquid flow path 10, respectively. Therefore, a plurality of discharge modes are obtainable depending on which one of the heating members 2 and 3 is driven.

At first, with reference to FIGS. 7A to 7F, the discharge operation will be described when driving the heating member 2 on the upstream side.

Figure 7A:
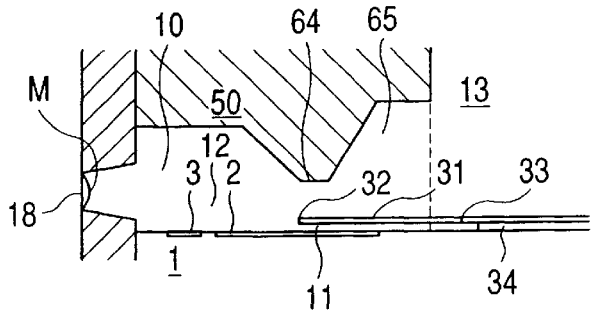
FIGS. 7A, 7B, 7C, 7D, 7E and 7F are cross-sectional views which illustrate the liquid discharge head in accordance with a second embodiment of the present invention, taken along in the liquid flow path direction, and which illustrate the characteristic phenomena in each of the liquid flow paths by dividing the process into those of A to F when the heating member on the upstream side is driven.

FIG. 7A shows the state before energy, such as electric energy, is applied to the heating member 2, which illustrates the state before the heating member 2 generates heat. What is important here is that the movable member 31 is positioned to face a half of the bubble on the upstream side for each of the bubbles created by the heating of the heating member 2, and the stopper 64 that regulates the displacement of the movable member 31 is arranged above the central portion of the bubble generation area 11. In other words, with the structure of the flow paths and arrangement position of each of the movable members 31, a half of the bubble on the upstream side is held down to the movable member 31.

Figure 7B:
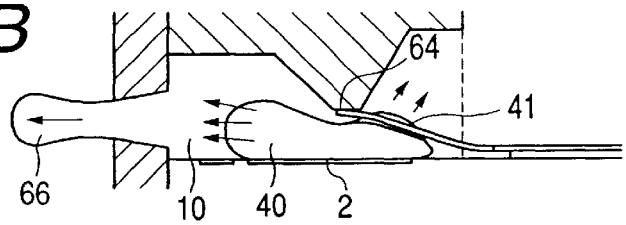

FIG. 7B shows the state in which a part of the liquid filled in the bubble generation area 11 is heated by the heating member 2 so that the bubble 40 is developed to the maximum along with film boiling. Then, the liquid in the liquid flow path 10 shifts to the downstream side and the upstream side due to the pressure waves based upon the creation of the bubble 40. Now, on the upstream side, the movable member 31 is displaced by the liquid flow that follows the development of the bubble 40, and on the downstream side, the discharge liquid droplet 66 is being discharged from the discharge port 18. Here, the liquid shift to the upstream side, that is, toward the common liquid chamber 13, becomes a large flow by means of the lower flow path resistance area 65. However, when the movable member 31 has displaced until it approaches the stopper 64 or it is in contact with the stopper, any further displacement thereof is regulated, hence restricting the liquid shift to the upstream side largely at that point. At the same time, the development of the bubble 40 to the upstream side is also restricted by the presence of the movable member 31. Nevertheless, since the shifting force of the liquid in the direction toward the upstream side is great, the movable member 31 receives the stress in the form that it is pulled in the upstream direction. Further, a part of the bubble 40 whose development is restricted by the movable member 31 passes the slight gaps between the sides of the movable member 31 and the walls on both sides formed by each of the liquid flow paths 10 to be extruded to the upper surface side of the movable member 31. The bubble thus extruded is termed as the "extruded bubble 41" in the specification hereof.

Figure 7C:
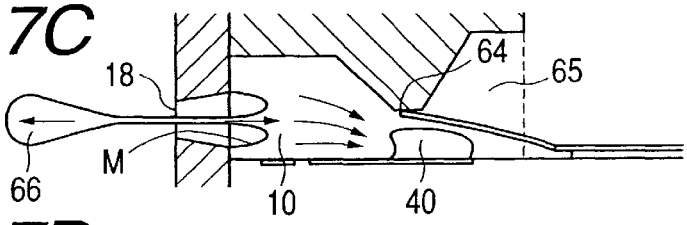

FIG. 7C shows the state where the contraction of the bubble 40 begins when the negative pressure in the bubble overcomes the liquid shift in the liquid flow path to the downstream side subsequent to the film boiling described earlier. At this juncture, the liquid force exerted by the bubble development in the upstream direction still remains largely. As a result, the movable member 31 is still in contact with the stopper 64 for a specific period of time after the contraction of the bubble 40 has begun. Most of the contraction of the bubble 40 creates the liquid shift from the discharge port 18 in the direction toward the upstream. In other words, immediately after the state sown in FIG. 7B, the stopper 64 is in contact with the displaced movable member 31 so as to make the liquid flow path 10 having the bubble generation area 11 essentially closed space with the exception of the discharge port 18. Consequently, the energy exerted by the contraction of the bubble 40 is allowed to act as the force that shifts the liquid in the vicinity of the discharge port 18 to shift in the upstream direction. As a result, the meniscus M is then drawn from the discharge port 18 largely into the liquid flow path 10 to cut off the liquid column connected with the discharged liquid droplet 66 quickly with a strong force. Thus, as shown in FIG. 7D, the number of satellites (sub-droplets) 67 which are left outside the discharge port 18 is reduced significantly.

Figure 7D:
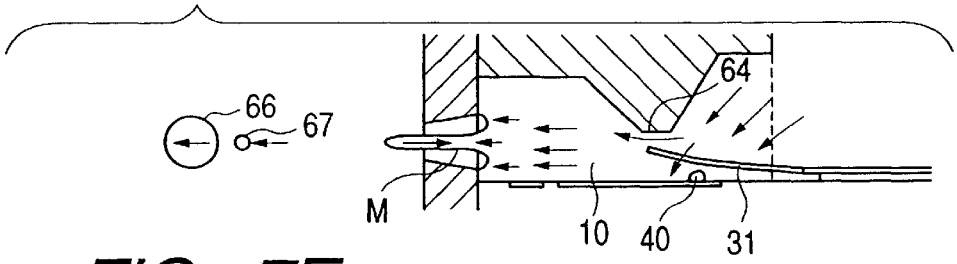

FIG. 7D shows the state where the discharge liquid droplet 66 whose bubble disappearing process is completed, and the meniscus M are cut off. In the lower flow path resistance area 65, the resiliency of the movable member 31 overcomes the shifting force of the liquid in the upstream direction. Then, the movable member 31 begins its downward displacement. Along with this, the flow in the lower flow path resistance area 65 begins in the downstream direction. At the same time, with the flow in the downstream direction of the lower flow path resistance area 65, which has a smaller flow path resistance, the current becomes larger rapidly and flows into the liquid flow path 10 through the stopper 64 portion. As a result, the flow that causes the meniscus M to be drawn into the interior of the liquid flow path 10 is reduced abruptly. Then, the meniscus M begins to return in a comparatively slow speed to the position at which the bubbling is originated, while drawing the liquid column which remains outside the discharge port 18. In this manner, the vibrations of the meniscus are settled at a high speed.

On the other hand, the discharged liquid droplet 66 and the satellite 67 which follows immediately after the discharged liquid droplet are extremely close to each other due to the rapid meniscus drawing as shown in FIG. 7C. Here, then, the so-called slip stream phenomenon is created, which causes the satellite closely following the discharged liquid droplet to be attracted to it due to the eddy current occurring behind the discharged liquid droplet 66 in flight.

Now, this phenomenon will be described precisely. With the conventional liquid discharge head, the liquid droplet is not in the spherical form the moment liquid is discharged from the discharge port of the liquid discharge head. The liquid droplet is discharged almost in the form of a liquid column having it spherical part on the leading end thereof. Thus, the trailing portion is tensioned both by the main droplet and the meniscus, and when it is cut off from the meniscus, the satellite dots are formed with the trailing portion. Here, it is known that the satellites fly to a recording medium together with the main droplet. The satellites fly behind the main droplet, and also, the satellites are drawn by the meniscus. Therefore, the discharge speed thereof is slower to that extent to cause its impacted position to be deviated from that of the main droplet. This inevitably degrades the quality of prints. In accordance with the liquid discharge head of the present invention, the force that draws back the meniscus is much greater than the conventional liquid discharge head as described earlier. Thus, the drawing force given to the trailing portion is stronger after the main droplet has been discharged. The force with which the trailing portion is cut from the meniscus becomes stronger to make its timing faster accordingly. Therefore, the satellite dot formed by the trailing portion becomes smaller, and the distance between the main dot and the satellite dot is made also shorter. Further, since the trailing portion is not drawn by meniscus continuously for a longer period, the discharge speed does not become slower. Then, the satellite 67 is drawn to the main droplet by the slip stream phenomenon occurring behind the discharged liquid droplet 66.

Figure 7E:
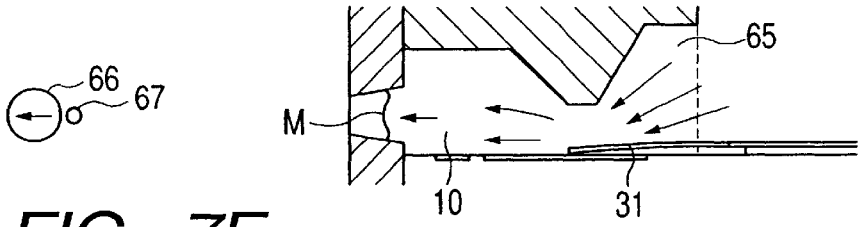

FIG. 7E shows the condition where the state illustrated in FIG. 7D has further advanced. Here, the satellite 67 is still closer to the discharged liquid droplet 66, at the same time, being drawn to it. Then, the drawing force exerted by the slip stream phenomenon becomes greater. On the other hand, the liquid shift from the upstream side in the direction toward the discharge port 18 creates the phenomenon that the liquid is drawn from the upstream side, and the liquid is pushed out in the discharge port 18 direction, because the overshot displacement of the movable member 31 causes it to be displaced lower than the initial position. Further, by the expansion of the sectional area of the liquid flow path due to the presence of the stopper 64, the liquid flow is increased in the direction toward the discharge port 18 to enhance the restoring speed of the meniscus M to the discharge port 18. In this manner, the refilling characteristic of the present embodiment is drastically improved.

Figure 7F:
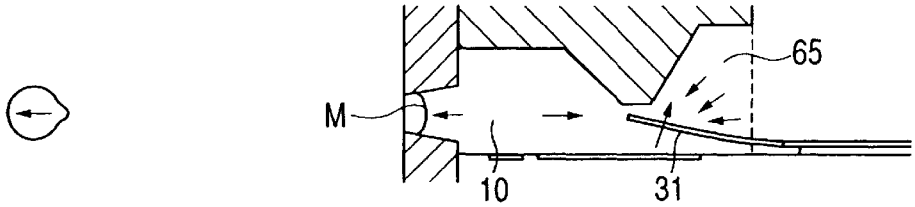

FIG. 7F shows the condition in which the state illustrated in FIG. 7E has further advanced, and the satellite 67 is caught into the discharged liquid droplet 66. The combined body of the discharged liquid droplet 66 and the satellite 67 is not necessarily the phenomenon that should occur under any circumstances per discharge for other embodiments. Depending on conditions, such phenomenon takes place or it does not take place at all. However, by eliminating the satellites or at least by reducing the number of satellites, there is almost no deviation between the impact positions of the main droplet and the satellite dots on the recording medium so as to minimize the adverse effect that may be produced on the quality of prints. In other words, the sharpness of printed images is enhanced to improve the quality of prints, and at the same time, it becomes possible to avoid making them mists and reduce the occurrence of the damage that the mist thus created may stain the printing medium or the interior of the recording apparatus.

In the meantime, the movable member 31 is again displaced in the direction toward the stopper 64 due to the reaction of its overshooting. Then, it is settled by the attenuating vibrations which are determined by the configuration of the movable member 31, the Young's modulus, the viscosity of liquid in the liquid flow path, and the gravity, and lastly, the movable member comes to a stop at its initial position. With the upward displacement of the movable member 31, the liquid flow from the common liquid chamber 13 side in the direction toward the discharge port 18 is controlled in order to settle the movement of the meniscus M quickly in the vicinity of the discharge port. Therefore, it becomes possible to drastically reduce the overshooting phenomenon of the meniscus and other factors that may cause the unstable discharge condition to degrade the quality of prints.

Now, the description will be made of the further effects characteristic of the case where the heating member 2 on the upstream side is driven.

Figure 9:
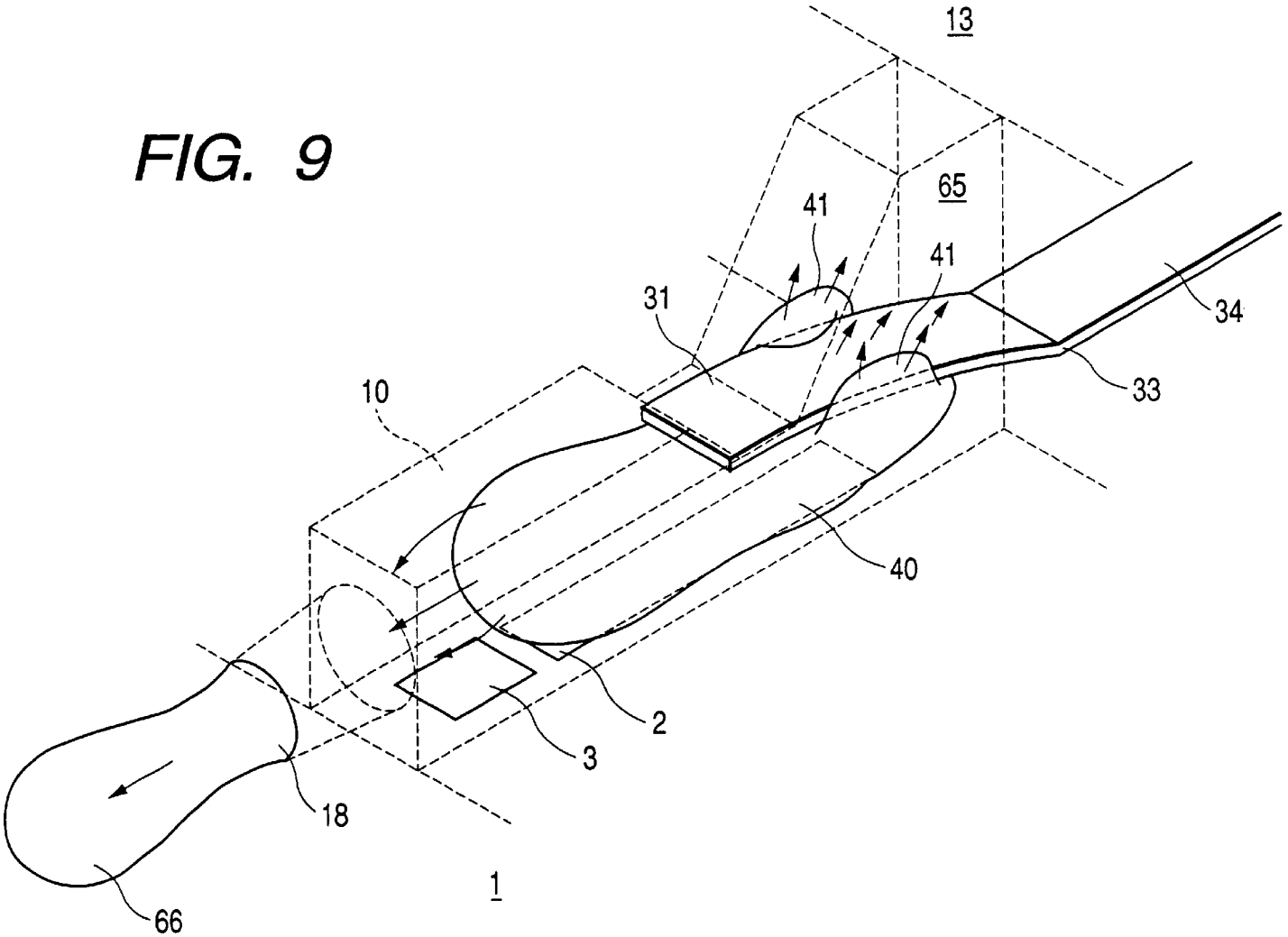
FIG. 9 is a perspective view which shows a part of the head represented in FIG. 7B.

FIG. 9 is a perspective view which shows a part of the head represented in FIG. 7B, which shows the same state as FIG. 7B fundamentally with the exception of the nozzle which is indicated perspectively by dotted lines. In accordance with the present embodiment, there are slight clearances between both side wall faces of the wall that constitutes the liquid flow path 10, and both side portions of the movable member 31 to make it possible to displace the movable member 31 smoothly. Further, in the development process of the bubble by use of the heating member 2, the bubble 40 displaces the movable member 31, and at the same time, it is extruded to the upper surface side of the movable member 31 and enter slightly the lower flow path resistance area 65 through the clearances described above. The extruded bubble 41 thus entered advances around to the back side of the movable member 31 (the plane opposite to the bubble generation area 11) to suppress the deflection of the movable member 31 to stabilize the discharge characteristics.

Further, in the bubble disappearing process of the bubble 40, the extruded bubble 41 promotes the liquid flow from the lower flow path resistance area 65 to the bubble generation area 11, and together with the high speed drawing of the meniscus from the discharge port 18 side as described earlier, the bubble disappearing is completed quickly. Particularly, by the liquid flow created by the provision of the extruded bubble 41, there is almost no possibility that bubbles are allowed to reside on the corners of the movable member 31 and the liquid flow path 10.

Now, with reference to FIGS. 8A to 8E, the description will be made of the discharge operation when the heating member 3 on the downstream side is driven.

Figure 8A:
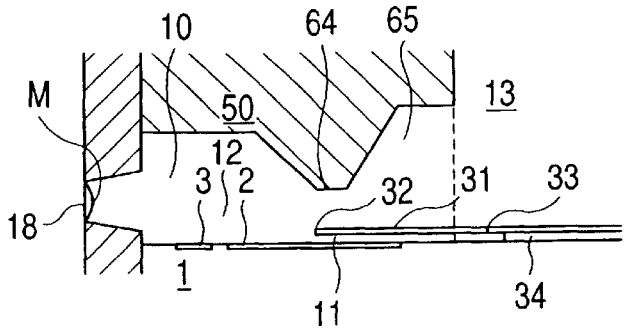
FIGS. 8A, 8B, 8C, 8D, 8E and 8E are cross-sectional views which illustrate the liquid discharge head represented in FIGS. 7A to 7F, showing the characteristic phenomena in each of the liquid flow paths by dividing the process into those of A to E when the heating member on the downstream side is driven.
Figure 8B:
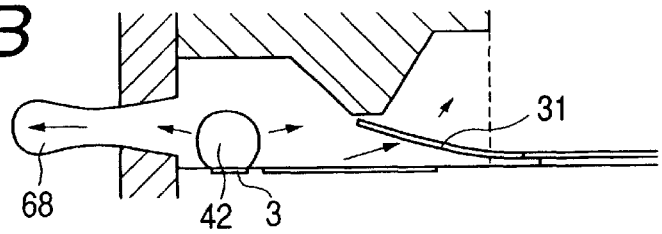

FIG. 8B shows the state in which a part of the liquid filled in the bubble generation area 12 is heated by the heating member 3 on the downstream side so that the bubble 42 is developed to the maximum along with film boiling. Then, on the downstream side, the discharge liquid droplet 68 is being discharged from the discharge port 18. The size of this discharge liquid droplet is smaller than that of the discharge liquid droplet 66 (see FIGS. 7A to 7F) which is discharged by the driving of the heating member 2 on the upstream side. Here, on the other hand, the liquid flow occurs on the upstream side. However, since the movable member 31 is displaced to a certain extent by that flow, the liquid flow to the upstream side is restricted.

Figure 8C:
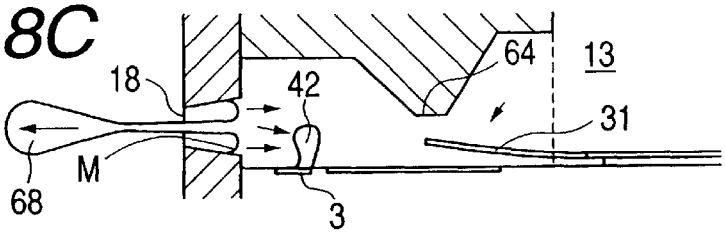

FIG. 8C shows the contraction process of the bubble 42. In this case, the bubble disappearing point of the bubble 42 is deviated from the center of the heating member 3 to the upstream side, because the flow path resistance from the bubble 42 to the common liquid chamber 13 is considerably greater than the flow path resistance from the bubble 42 to the discharge port 18, because of its longer distance and the smaller sectional area of the flow path by the presence of the movable member 31 and the stopper 64. This means that the meniscus M is drawn larger to enable the discharge droplet 68 to maintain the sufficient discharge velocity, while suppressing the discharge amount to a lower level.

Figure 8D:
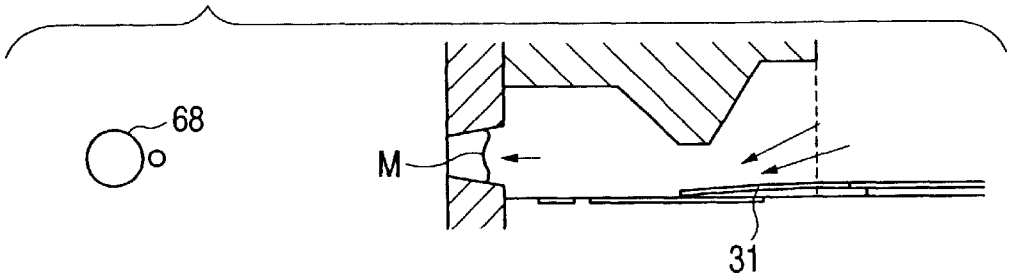

FIG. 8D shows the completion of the bubble disappearing process, and also, shows the state where the discharge liquid droplet 68 and the meniscus M are cut off. In this state, the movable member 31 is displaced downward after the bubble disappearing of the bubble. Thus, the flow path resistance is smaller, and the meniscus M is restored at a high speed.

Figure 8E:
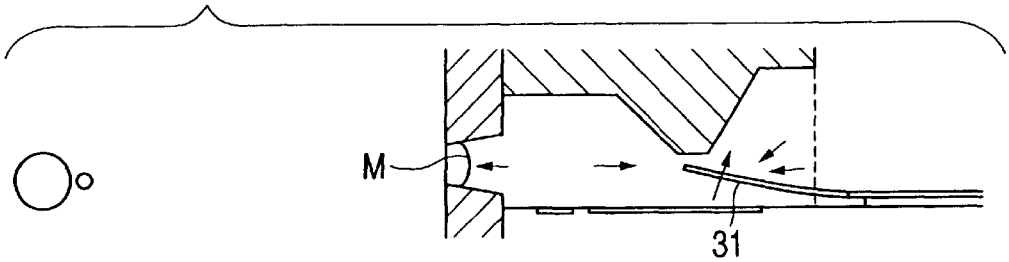

In FIG. 8E, the movable member 31 is displaced upward by its resiliency to suppress the high speed liquid flow from the upstream side, hence settling the operation of meniscus M quickly. As in the case of FIGS. 7A to 7F, it becomes possible to stabilize the discharge condition by the stabilized movement of the meniscus M, and then, to improve the quality of prints.

As has been described above, the liquid discharge head of the present embodiment implements the high-speed printing by means of larger liquid droplets, and the high quality printing by means of smaller liquid droplets using each of the heating members 2 on the upstream side described in conjunction with FIGS. 7A to 7F, and each of the heating members 3 on the downstream side described in conjunction with FIGS. 8A to 8E.

Particularly, the heat member 2 for use of the larger liquid droplets is positioned on the upstream side of the heating member 3 for use of the smaller liquid droplets, and the bubble 40 created by the heating member 3 is divided by use of the stopper 64 and the movable member 31 on the central area, thus making it possible to stably discharge the larger liquid droplet and the smaller liquid droplet at high speeds. Also, it becomes possible to reduce the number of satellites and the vibrations of the meniscus, and obtain the high quality of prints. To described more precisely, it is necessary to keep the discharge speed of each of the liquid droplets at a certain level or higher. In accordance with the present invention, the heating member 3 for use of the smaller liquid droplets is arranged on the side nearer to the discharge port 18 to enhance the discharge speed, and at the same time, to enhance the speed in which the meniscus M should be drawn by the function of the movable member 31, hence suppressing the discharge amount to become greater. Also, with the arrangement of the heating member 2 for use of the larger liquid droplets on the upstream side, it is made possible to suppress the bubble 40 to be developed to the common liquid chamber 13 side by the presence of the movable member 31, thus maintaining the highly reliable discharge condition.

Further, since only one movable member 31 is arranged for the liquid flow path 10 one to one, it becomes possible to minimize the space on the elemental substrate 1, which is needed for supporting the movable member as compared with the case where the movable members are arranged for each of the heating members 2 and 3, respectively. Also, the free end 32 of the movable member 31 is positioned above the heating member 2 on the upstream side. As a result, the movable member 31 is not needed to be longer to make the displacement response of the movable member 31 better along with the development of each of the bubbles 40 and 42. Therefore, when each of the heating members 2 and 3 is driven at high frequency, the movable member 31 functions reliably with respect to the liquid and each of the bubbles 40 and 42 in the liquid flow path 10.

So far, the description has been made of the case where the two heating members 2 and 3 are driven individually to discharge liquid, but it may be possible to drive the two heating members 2 and 3 at a time to discharge larger liquid droplets.

Now, with reference to FIGS. 10A to 10F, the description will be made of the method for discharging still larger liquid droplets by driving the two heating members 2 and 3 at a time.

If it is attempted to drive the heating members 2 and 3 at a time to discharge still larger liquid droplets, the discharge amount can be increased, but the quality of prints tends to be degraded due to the increased number of satellites. In accordance with the present invention, however, the heating member 2 on the upstream side is driven with a retard timing after the heating member 3 on the downstream side has been driven. In this manner, it is implemented to increase the discharge amount stably.

Figure 10A:
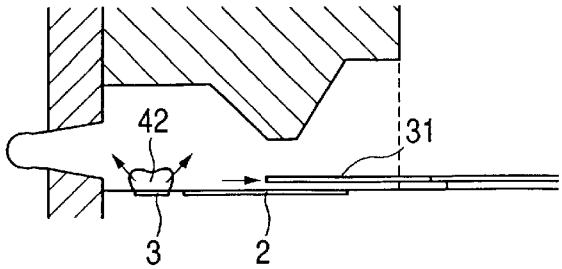
FIGS. 10A, 10B, 10C, 10D, 10E and 10F are cross-sectional views which illustrate the liquid discharge head represented in FIGS. 7A to 7F, showing the characteristic phenomena in each of the liquid flow paths by dividing the process into those of A to F when the two heating members are driven.
Figure 10B:
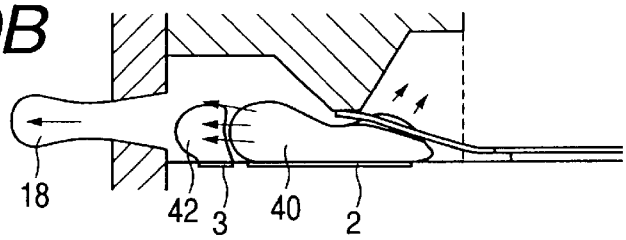

At first, as shown in FIG. 10A, the heating member 3 on the downstream side is driven to create the bubble 42. Then, as shown in FIG. 10B, the bubble 40 is created by use of the heating member 2 on the upstream side after approximately 5 to 15 μs since the heating member 3 has been driven. In this case, the bubble 42 created by the heating member 3 on the downstream side has shifted to the contracting process. However, the liquid flow to the discharge port 18 is generated differentially by the creation of the bubble 40 having a large volume to keep the later discharge to the extent that the discharge speed is increase extremely. As a result, it becomes possible to implement the discharge of still larger liquid droplets at a stable discharge speed (usually, 8 to 20 m/s or preferably, 10 to 18 m/s).

Figure 10C:
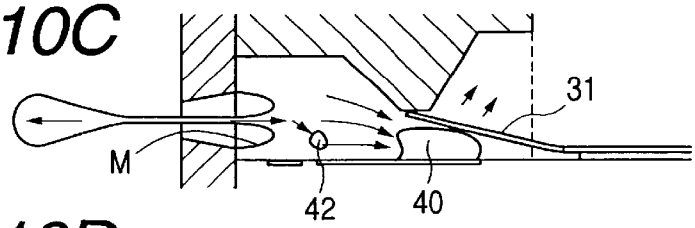
Figure 10D:
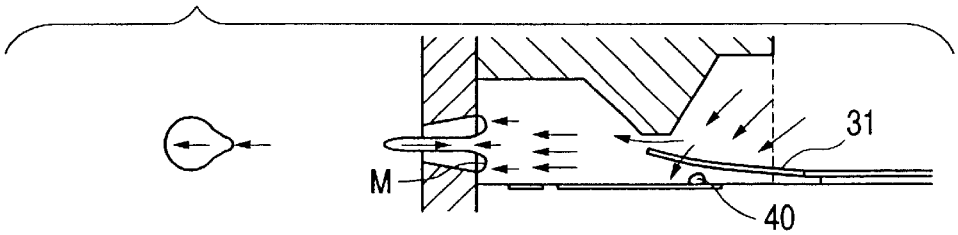
Figure 10E:
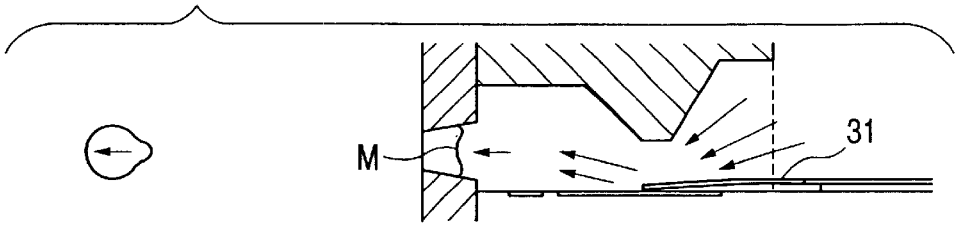
Figure 10F:
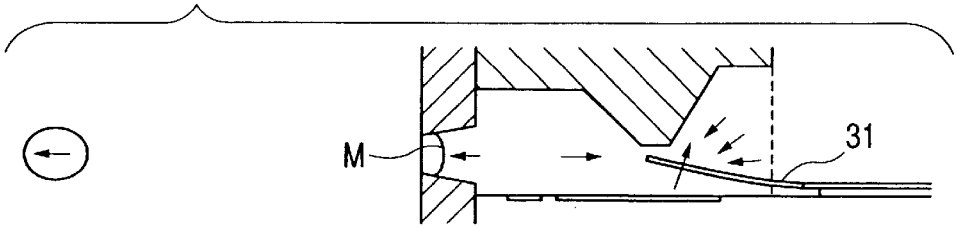

In FIG. 10C, with the bubble disappearing of the bubbles 40 and 42, and the displaced condition of the movable member 31, the meniscus M is drawn at a high speed to implement the reduction of the number of satellites. In the process shown in FIGS. 10D and on, the same functional effects are produced fundamentally as those in the case of FIGS. 7D and on.

(Other Embodiments)

Now, hereunder, the description will be made of various embodiments applicable to the head using the liquid discharge method described above.

(Movable Member)

Figure 11A:
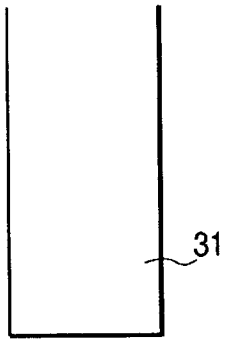
FIGS. 11A, 11B and 11C are views which illustrate another configuration of the movable member shown in FIGS. 2A to 2F, FIG. 3 and FIG. 4, respectively.
Figure 11B:
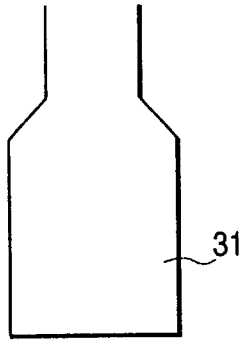
Figure 11C:
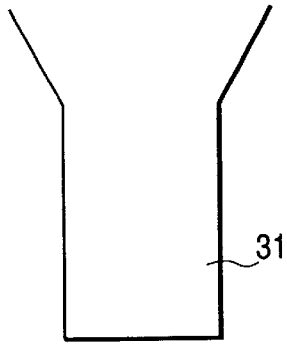

FIGS. 11A to 11C are views which illustrate the other configurations of the movable member 31. FIG. 11A shows a rectangular one; FIG. 11B, the one having the narrower fulcrum side which makes the operation of the movable member easier; and FIG. 11C, the one having the wider fulcrum side to enhance the robustness of the movable member.

For the previous embodiment, the movable member 31 is formed by nickel of 3 μm thick. However, the material is not necessarily limited to it. As the one that forms the movable member, it should be good enough if only the material has the solvent resistance to the discharge liquid, and also, the resiliency with which it can operate as a movable member in good condition.

As the material for the movable member 31, it is desirable to use the metal which has a high durability, such as silver, nickel, gold, iron, titanium, aluminum, platinum, tantalum, stainless steel, phosphor bronze, or the alloy thereof; resins of nitrile group, such as acrylonitrile, butadiene, styrene; resins of amide group, such as polyamide; resins of carboxyl group, such as polycarbonate; resins of aldehyde group, such as polyacetal; resins of sulfone group, such as polysulfone, or liquid crystal polymer or other resin and the compound thereof; the metal which has high resistance to ink, such as gold, tungsten, tantalum, nickel, stainless steel, titanium, or the alloy thereof or any one of them having it coated on the surface to obtain resistance to ink; or resins of amide group, such as polyamide; resins of aldehyde group, such as polyacetal; resins of ketone group, such as polyether ketone; resins of imide group, such as polyimide; resins of hydroxyl group, such as phenol resin; resins of ethyl group, such as polyethylene; resins of epoxy group, such as epoxy resin; resins of amino group, such as melamine resin; resins of methylol group, such as xylene resin and the compound thereof; or ceramics, such as silicon dioxide, silicon nitride and the compound thereof. For the movable member 31 of the present invention, it is intended to use the one in a thickness of μm order to serve the purpose.

Now, the description will be made of the arrangement relations between the heating member and the movable member. With the optimal arrangement of the heating member and the movable member, it becomes possible to appropriately control the liquid flow when bubbling is performed by means of the heating member, and to effectively utilize the liquid flow as well.

Figure 12:
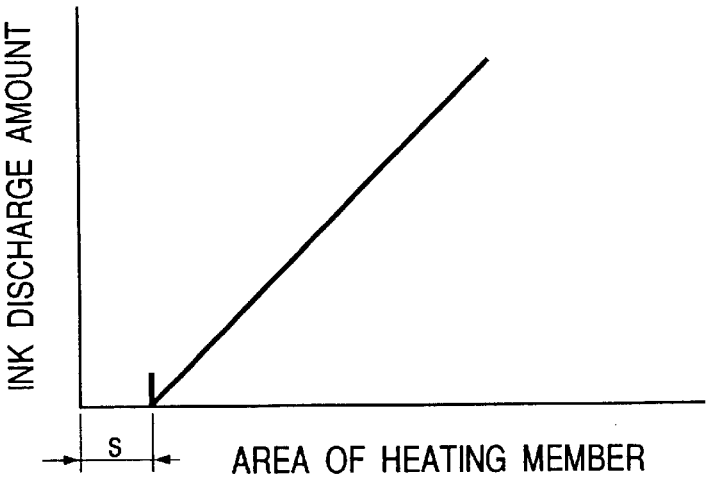
FIG. 12 is a graph which shows the correlations between the area of the heating member and the ink discharge amount.

In accordance with the conventional art that adopts the so-called bubble jet recording method, that is, with the application of thermal energy or the like to ink, the change of states is made, which is accompanied by the abrupt voluminal changes of ink (the creation of bubbles), and then, by the acting force based upon this change of states, ink is discharged from each of the discharge ports to cause it to adhere to a recording medium for the formation of images, it is clear from the representation of FIG. 12 that there is an area S in which no bubbling is effectuated, and which does not contribute to discharging ink, but it has bearing on the proportional relations between the area of the heating member and the amount of ink discharge. Also, from the burning condition observable on the heating member, it is understandable that this area S which does not effectuate bubbling is present on the circumference of each heating member. Then, it is assumed that a width of approximately 4 μm on the circumference of the heating member is not considered to participate in bubbling.

Therefore, in order to effectively utilize the bubbling pressure, the area for the effective action of each movable member should be arranged directly above the effective area of bubbling, which is inside the circumference of the heat member by approximately 4 μm or more. However, for the present invention, attention is given to the bubble which should act on the liquid flow in the liquid flow path on the upstream side and the downstream side almost on the central portion of the bubble generation area (which is, in practice, a range of approximately ±10 μm in the direction of liquid flow from the center), thus dividing the bubbling action into the stage where it is effectuated individually and the stage where it is effectuated integrally. Then, it is considered most important to make an arrangement so as to enable the movable member to face only the portion on the upstream side of the aforesaid central area. In accordance with the present embodiment, the effective area of bubbling is defined to be inside the circumference of the heating member by approximately 4 μm or more. However, this range is not necessarily limited to it. The range may be defined depending on the kinds of the heating member or the method of its formation.

Further, it is preferable to set the distance between the movable member and heating member at 10 μm or less on standby in order to form the aforesaid essentially closed space in good condition.

(Elemental Substrate)

Now, the structure of the elemental substrate will be described.

Figure 13A:
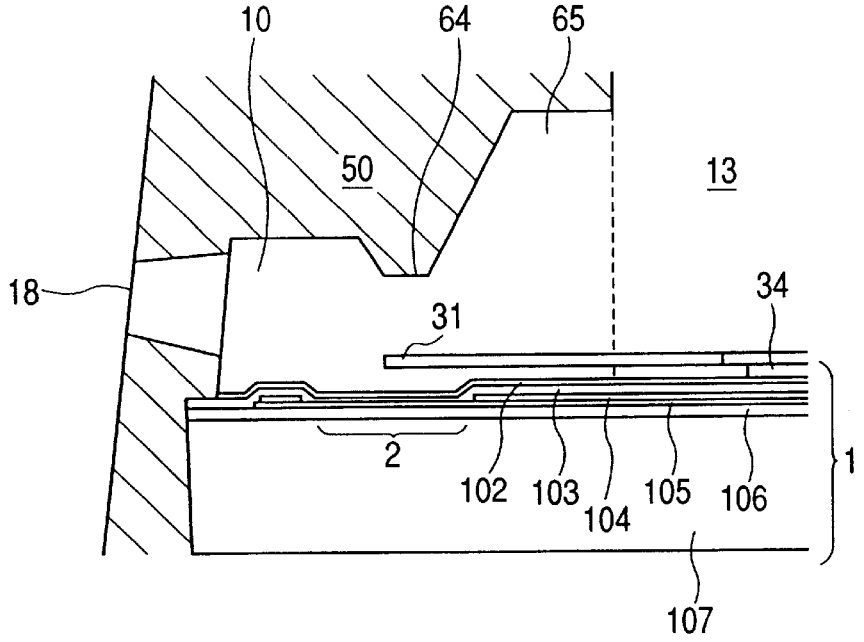
FIGS. 13A and 13B are vertically sectional views which illustrate the liquid discharge head in accordance with the present invention.
Figure 13B:
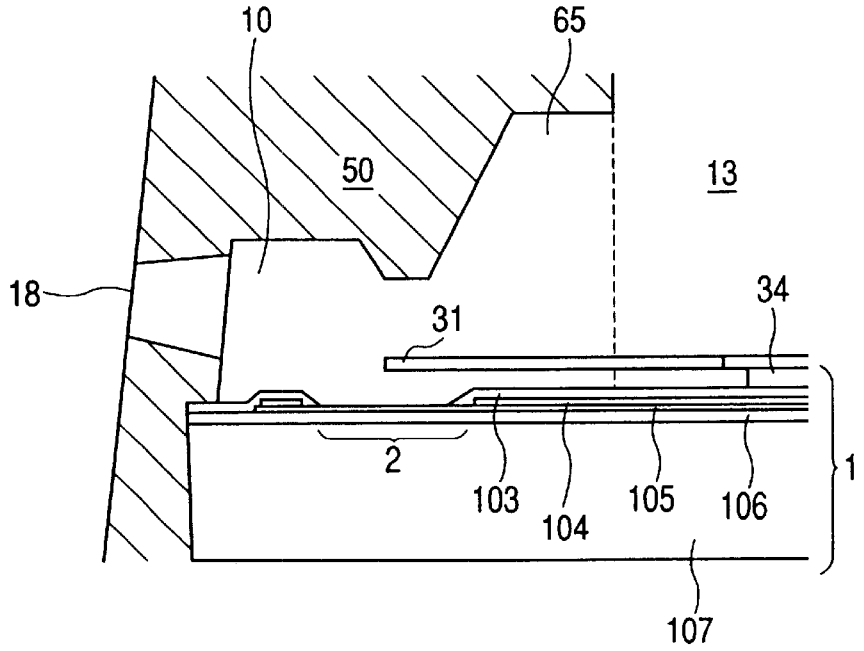

FIGS. 13A and 13B are vertically sectional views which illustrate the liquid jet head of the present invention. FIG. 13A shows the head which is provided with the protection film to be described later. FIG. 13B shows the one without the protection film.

The ceiling plate 50, which is provided with the grooves that constitute each of the liquid flow paths 10, the discharge ports 18 communicated with the liquid flow paths 10, the lower flow path resistance areas 65, and the common liquid chamber 13, is arranged on the elemental substrate 1.

On the elemental substrate 1, the silicon oxide film or the silicon nitride film 106 is formed for the substrate 107 using silicon or the like for the purpose of insulation and heat accumulation. On this film, the electric resistive layer 105 (0.01 to 0.2 μm thick) formed by hafnium boride ($HfB_2$), tantalum nitride (TaN), tantalum aluminum (TaAl), or the like, and the wiring electrodes of aluminum or the like (0.2 to 1.0 μm thick) 104 are patterned to form the heating member 2 as shown in FIG. 5A. With the wiring electrodes 104, voltage is applied to the resistive layer 105 to energize it for heating. On the resistive layer between the wiring electrodes, the protection layer 103 is formed by silicon oxide, silicon nitride, or the like in a thickness of 0.1 to 2.0 μm. Further on that, the anticavitation layer 102 formed by tantalum or the like (0.1 to 0.6 μm thick) is filmed to protect the resistive layer 105 from ink or various other liquids.

Particularly, the pressure and impulsive waves generated at the time of creation and extinction of bubbles are extremely strong, which cause the durability of the hard but brittle oxide film and make it considerably lowered. Therefore, metallic material, such as tantalum (Ta), is used for the anticavitation layer 102.

Also, by the combination of the liquid, the liquid flow path structure, and the resistive material, a structure may be arranged without any protection layer 103 provided for the aforesaid resistive layer 105. Such example is shown in FIG. 13B. For the material used for the resistive layer 105 that does not need any protection layer 103, an alloy of iridium-tantalum-aluminum may be cited, among some others.

In this way, the structure of the heating member may be formed only with the resistive layer (heating member) between the electrodes. Also, it may be possible to provide the protection layer that protects the resistive layer.

Here, as each of the heating members, it is arranged to use the one structured with the resistive layer which gives heat in accordance with the electric signals as the heating unit, but the heating member is not necessarily limited to it. It should be good enough if only the heating member can create bubbles in bubbling liquid, which are capable of discharging the discharge liquid. For example, it may be possible to use the heating member having the opto-thermal converting element that gives heat when receiving laser or other beams or having the heating unit that gives heat when receiving high frequency.

Here, for the aforesaid elemental substrate 1, it may be possible to incorporate, in the semiconductor manufacturing process, the transistors, diodes, latches, shift registers, or some other functional elements integrally for driving the electrothermal transducing devices selectively, besides the devices each of which is formed by the resistive layer 105 to constitute the heating unit as described earlier, and the wiring electrodes 104 to supply electric signals to such resistive layer.

Figure 14:
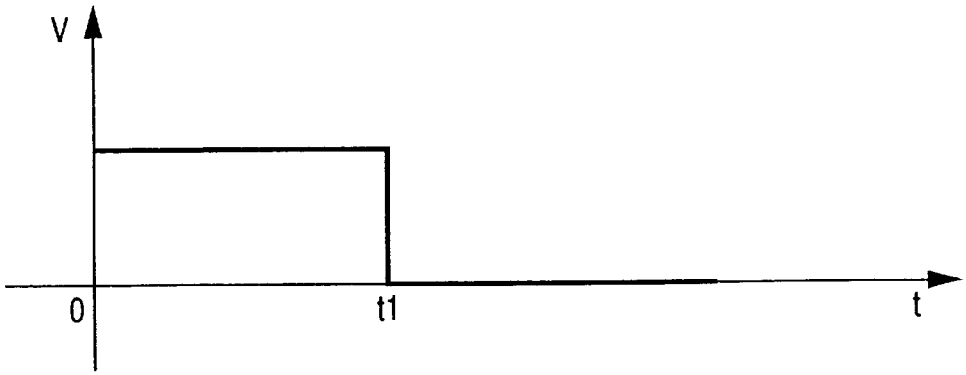
FIG. 14 is a view which shows the driving waveform of the heating member used for the present invention.

Also, in order to discharge liquid by driving the heating unit of the electrothermal transducing devices arranged for the elemental substrate 1 as described above, the rectangular pulse as shown in FIG. 14 is applied to the resistive layer 105 though the wiring electrodes 104 to cause the resistive layer 105 to be heated abruptly between the wiring electrodes. For the head of each of the embodiments described earlier, the heating member is driven by the application of the voltage at 24V, the pulse width approximately in 4 μsec, the current of approximately 100 mA, and the electric signals at 6 kHz or more. Then, ink which serves as the liquid is discharged from each of the discharge ports by the operation which has described earlier. However, the condition of the driving signal is not necessarily limited to it. It should be good enough if only the driving signal can bubble the bubbling liquid appropriately.

(Discharge Liquid)

Of the liquids described above, it is possible to adopt, for recording, the ink having the composition usable for the conventional bubble jet apparatus as the liquid (recording liquid) here.

Also, it is possible to utilize the liquid having a lower bubbling capability; the one whose property is easily changeable or deteriorated by the application of heat; or the highly viscose liquid, among some others, which cannot be used conventionally with ease.

However, it is desirable to avoid using the liquid which tends to impede, as the discharge liquid itself as its property, the discharge, the bubbling, the operation of the movable member, or the like.

As the discharge liquid for recording use, it is possible to utilize the highly viscose ink or the like. Besides, in accordance with the present invention, the recording is made by use of the recording liquid having the following composition as the one adoptable for the discharge liquid:

| Composition of Dye Ink (Viscosity 2cP) | |
|---|---|
| (C-1, Food black 2) color | 3 wt % |
| diethylene glycol | 10 wt % |
| thiodiglycol | 5 wt % |
| ethanol | 5 wt % |
| water | 77 wt % |

With the enhanced discharge power, the discharge velocity of ink becomes higher to make it possible to obtain recorded images in excellent condition with the enhanced impact precision of the liquid droplets.

(The Structure of the Liquid Discharge Head)

Figure 15:
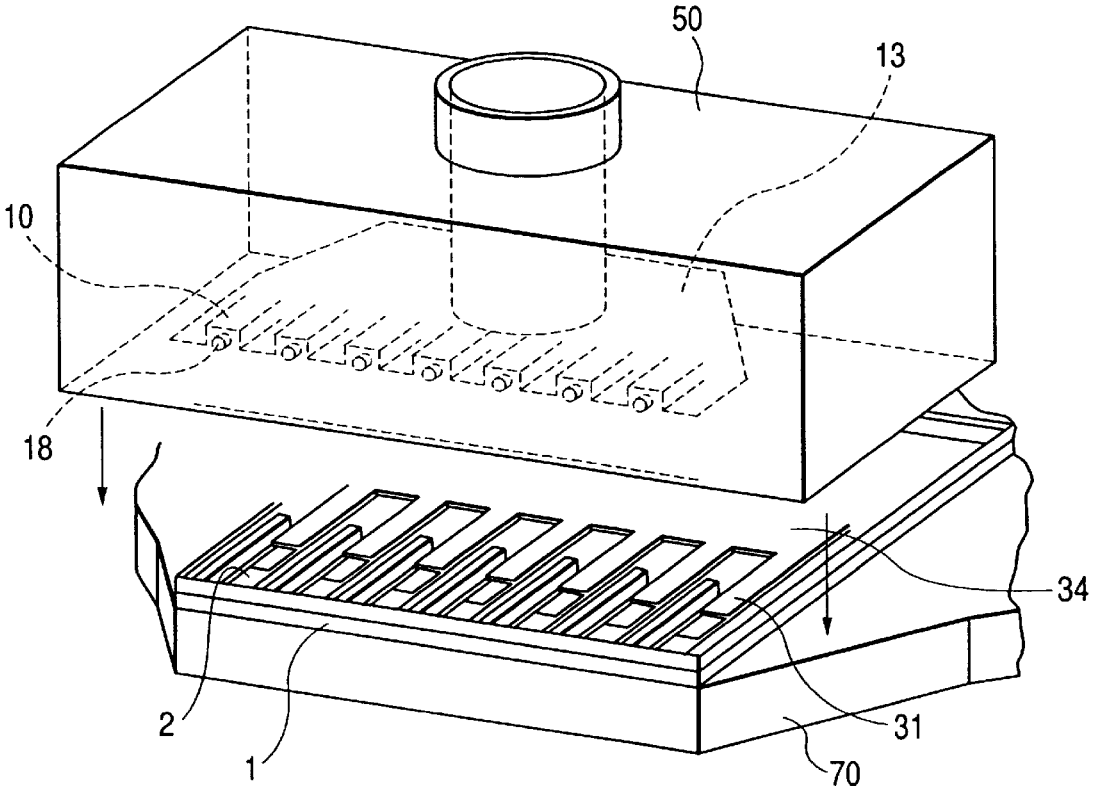
FIG. 15 is an exploded perspective view which shows the entire structure of the liquid discharge head in accordance with the present invention.

FIG. 15 is an exploded perspective view which shows the entire structure of the liquid discharge head in accordance with the present invention.

The elemental substrate 1 having a plurality of heating members 2 provided therefor is arranged on the supporting member 70 formed by aluminum or the like. The supporting member 34 that supports movable members 31 is arranged so that each of the movable members faces a half of each of the heating members 2 on the common liquid chamber 13 side, respectively. Further on it, the ceiling plate 50 is arranged with a plurality of grooves that constitute the liquid flow paths 10, and a recessed groove of the common liquid chamber 13 as well.

(Side Shooter Type)

Figure 16A:
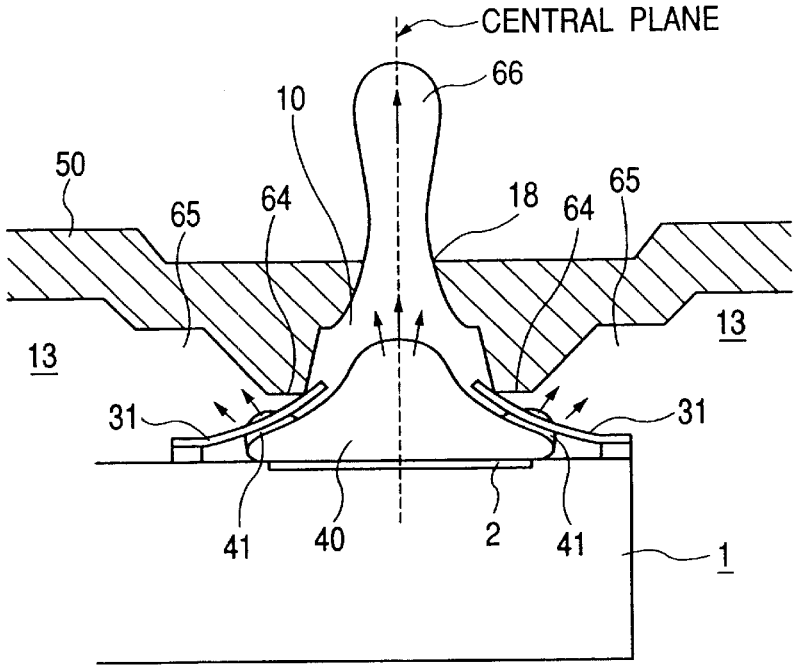
FIGS. 16A and 16B are views which illustrate the head of side shooter type to which the liquid discharge method of the present invention is applicable.
Figure 16B:
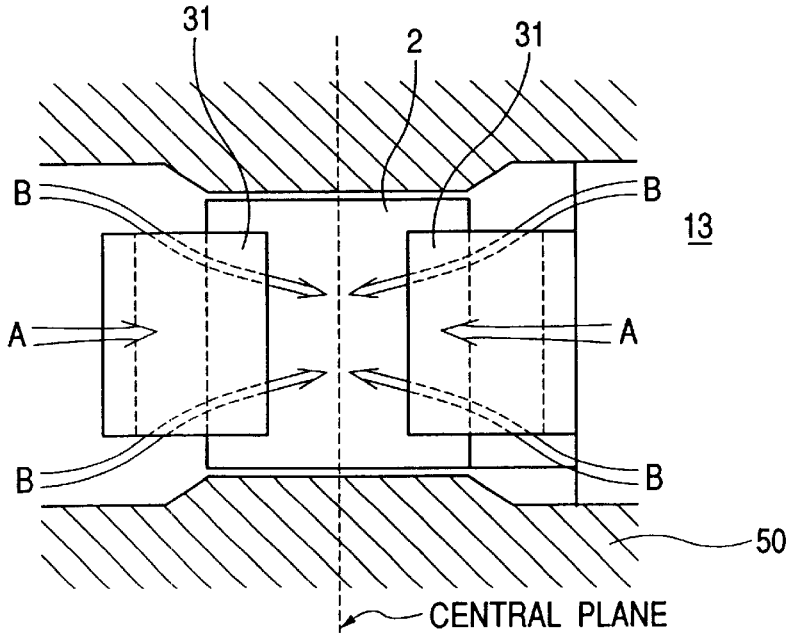

Here, the description will be made of the side shooter type head having the heating members and discharge ports facing each other on the parallel surfaces, to which is applied the liquid discharge principle described in conjunction with FIGS. 1A to 1F to FIGS. 5A to 5F. FIGS. 16A and 16B are views which illustrate this side shooter type head.

In FIGS. 16A and 16B, the heating members 2 arranged on the elemental substrate 1 and the discharge ports 18 formed on the ceiling plate 50 are arranged relatively to face each other. Each of the discharge ports 18 is communicated with the liquid flow path 10 which passes on the heating member 2. In the vicinity of the area of the surface where liquid and the heating member 2 are in contact, the bubble generation area is present. Then, two movable members 31 are supported on the elemental substrate 1 each in the form to be in plane symmetry with respect to the surface that passes the center of the heating member. The free ends of the movable members 31 are positioned to face each other on the heating member 2. Also, each of the movable members 31 has the same projection area to the heating member 2, and each of the free ends of the movable member 31 is apart from each other in a desired dimension. Here, if it is assumed that each of the movable members is separated by the separation wall that passes the center of the heating member, each of the free ends of the movable members is positioned in the vicinity of the center of the heating member, respectively.

Each of the stoppers 64 is arranged for the ceiling plate 50 to regulate the displacement of each movable member 31 within a certain range. In the flow from the common liquid chamber 13 to the discharge port 18, the lower flow path resistance area 65, which has the relatively low flow path resistance as compared with the liquid flow path 10, is arranged on the upstream side with the stopper 64 as the boundary. In this area 65, the structure of the flow path has a wider flow path section than that of the liquid flow path 10, hence making the resistance smaller, which the liquid receive from it when it shifts.

Now, the description will be made of the characteristic functions and effects of the structure in accordance with the present embodiment.

FIG. 16A shows the state where a part of the liquid filled in the bubble generation area 11 is heated by the heating member 2, and the bubble 40 is developed to the maximum along with the film boiling. At this juncture, by the pressure exerted by the creation of the bubble 40, liquid in the liquid flow path 10 shifts in the direction toward the discharge port 18, and each of the movable members 31 is displaced by the development of the bubble 40 to cause the discharge liquid droplet 66 to be ready for its flight out of the discharge port 18. Here, the liquid shift in the direction toward the common liquid chamber 13 becomes a great flow by each of the lower flow path resistance areas 65. However, when the two movable members 31 are displaced to approach or to be in contact with each of the stoppers 64, any further displacement is regulated, and then, the liquid shift in the direction toward the common liquid chamber 13 is also largely restricted there. At the same time, the development of the bubble 40 to the upstream side is also restricted by the movable members 31. However, since the shifting force of the liquid to the upstream side is great, a part of the bubble 40 the development of which is restricted by each of the movable members 31 is extruded on the upper surface side of the movable members 31 through the gaps between the side walls that form the liquid flow path 10 and the side portions of the movable members 31. In other words, the extruded bubble 41 is formed here.

When the contraction of the bubble 40 begins subsequent to a film boiling of the kind, the force of the liquid in the upstream direction remains greatly. Then, each of the movable members 31 is still in contact with the stopper 64. Therefore, the contracted bubble 40 mostly generates the liquid shift in the direction toward the upstream side from the discharge port 18. Thus, the meniscus is largely drawn into the liquid flow path 10 from the discharge port 18 at that time, and cuts off, with a strong force, the liquid column connected with the discharged liquid droplet 66 quickly. Consequently, the satellites which are liquid droplets left outer side of the discharge port 18 become smaller.

When the bubble disappearing process is almost completed, the resiliency (restoring force) of each movable member 31 overcomes the liquid shift in the upstream direction in each of the lower flow path resistance areas 65, and the downward displacement of each movable member 31 begins, and then, the flow in the downstream direction also begins in the lower flow path resistance area 65 along with this displacement. Since the flow path resistance is smaller in the flow in the downstream direction in the lower flow path resistance area 65, this current becomes a larger one rapidly to flows in the liquid flow path 10 through each of the stopper 64 portions. FIG. 16B shows the flows in the bubble disappearing process of the bubble 40 as designated by the reference marks A and B. The flow A indicates the component of the liquid that flows from the common liquid chamber 13 in the direction toward the discharge port 18 through the upper side (the face opposite to the heating member) of the movable member 31. The flow B indicates the component of the liquid that flows through both sides of the movable member 31 and on the heating member 2.

As described above, in accordance with the present embodiment, the liquid for discharge use is supplied from the lower flow path resistance area 65 so as to make the refiling velocity of the liquid higher. Also, the flow path resistance is made smaller still by the presence of the common liquid chamber 13 which is arranged adjacent to each of the lower flow path resistance areas 65, hence making it possible to effectuate the higher refilling.

Moreover, in the bubble disappearing process of the bubble 40, the extruded bubble 41 promotes the liquid flow from each of the lower flow path resistance areas 65 to the bubble generation area 11. Then, as described earlier, the bubble disappearing is completed quickly in cooperation with the high speed drawing of the meniscus from the discharge port 18 side. Here, in particular, there is almost no possibility that bubbles are stagnated on the movable members 31 or in the corners of the liquid flow paths 10 by the liquid flow effectuated by the presence of each of the extruded bubbles 41.

(The Liquid Discharge Apparatus)

Figure 17:
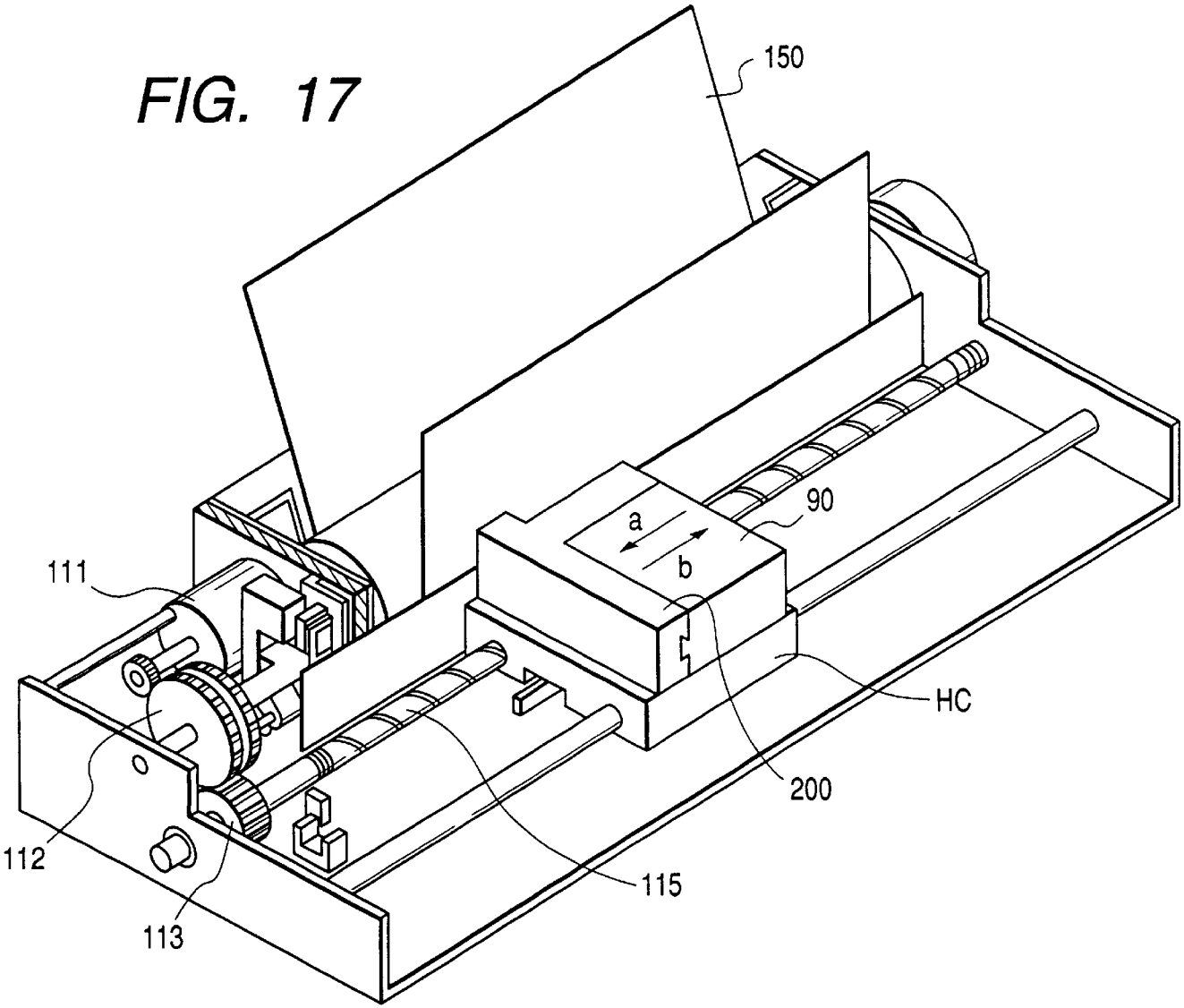
FIG. 17 is a view which schematically shows the structure of the liquid discharge apparatus having on it the liquid discharge head structured as illustrated in FIGS. 1A to 1F, FIGS. 16A and 16B.

FIG. 17 is a view which schematically shows the structure of the liquid discharge apparatus having the liquid discharge head structured as described in conjunction with FIGS. 1A to 1F and FIGS. 16A and 16B. For the present embodiment, the description will be made, in particular, of an ink discharge recording apparatus that uses ink as the discharge liquid. The carriage HC of the liquid discharge apparatus is arranged to mount on it the head cartridge on which the liquid tank unit 90 that contains ink, and the liquid discharge head unit 200 are detachably mounted. The carriage can reciprocate in the width direction of the recording medium 150, such as a recording sheet, which is carried by means for carrying the recording medium.

When driving signals are supplied from driving signal supplying means (not shown) to liquid discharge means on the carriage, the recording liquid is discharged from the liquid discharge head to the recording medium in accordance with the driving signals.

Also, in accordance with the liquid discharge apparatus of the present embodiment, there are provided the motor 111 serving as the driving source to drive the recording medium carrying means and the carriage as well; the gears 112 and 113 that transmit the driving power from the driving source to the carriage; and the carriage shaft 115, among others. With this recording apparatus and the liquid discharge method adopted for the recording apparatus, it is possible to obtain good images of recorded objects by discharging liquid onto various kinds of recording media.

Figure 18:
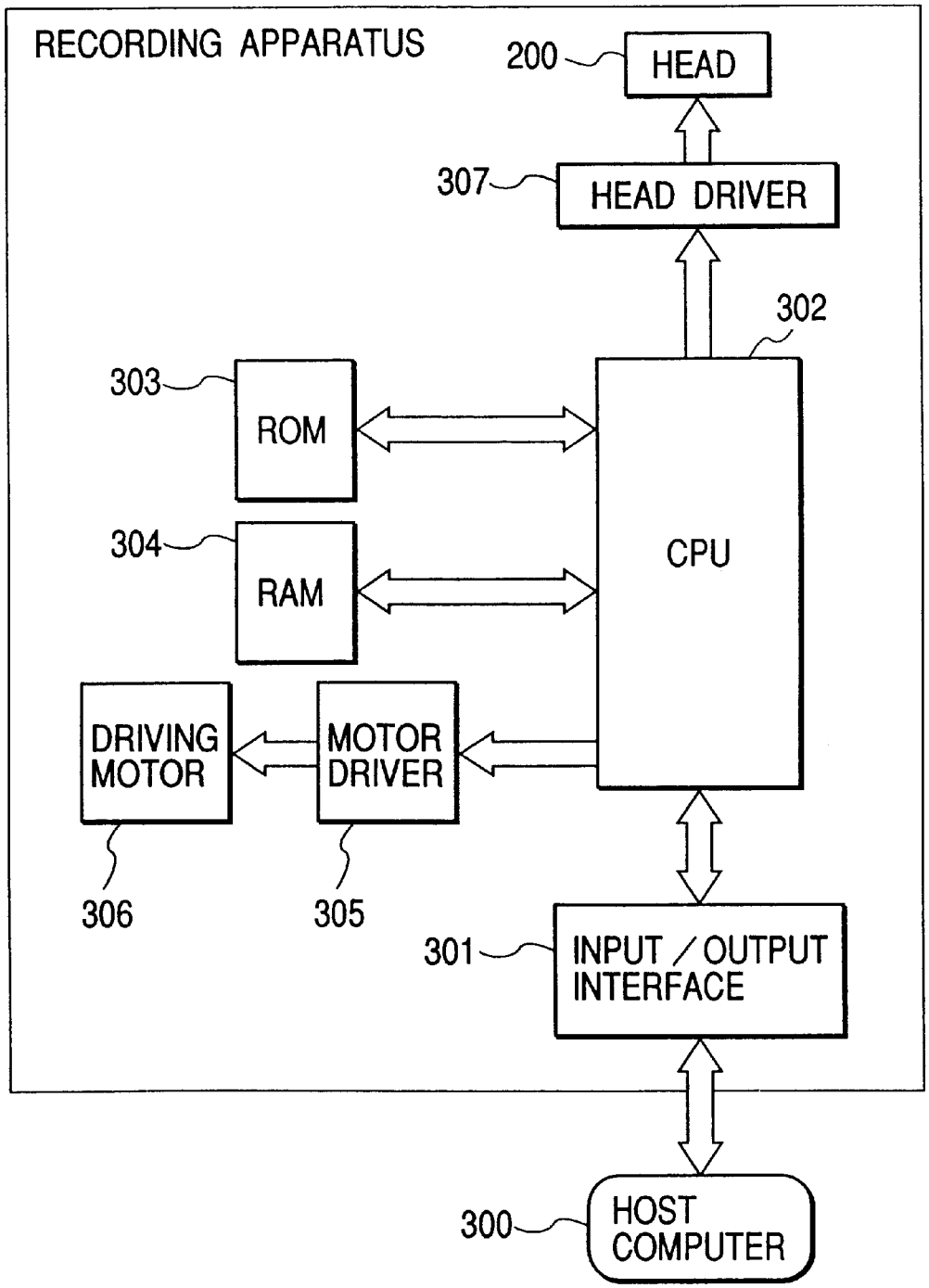
FIG. 18 is a block diagram which shows the apparatus as a whole whereby to operate the ink discharge recording in accordance with the liquid discharge method and liquid discharge head of the present invention.

FIG. 18 is a block diagram of the apparatus main body for operating the ink discharge recording by use of the liquid discharge method and liquid discharge head of the present invention.

The recording apparatus receives the printing information from the host computer 300 as the control signals. The printing information is provisionally held on the input interface 301 in the interior of the printing d4evice, and at the same time, converted into the data which can be processed in the recording apparatus, which are inputted into the CPU 302 which dually functions as means for supplying the head driving signals. The CPU 302 processes the data inputted into the CPU 302 by use of the RAM 304 and other peripheral devices in accordance with the control program stored on the ROM 303, hence converting them into the data (image data) used for printing.

Also, the CPU 302 produces the driving data for driving the driving motor which enables the recording medium and the recording head to shift in synchronism with the image data in order to record the image data on the appropriate positions on the recording medium. The image data and the motor driving data are transferred to the head 200 and the driving motor 306 through the head driver 307 and the motor driver 305, hence forming images by the head and the motor to be driven by the controlled timing, respectively.

As the recording medium which is applicable to the recording apparatus described above for the provision of ink or other liquid on it, there are various paper and OHP sheets, the plastic material usable for compact discs and ornamental boards, textile cloth, aluminum, copper, or some other metallic material, the leather material such as cowhide, pigskin, or artificial leather, wood material, such as woods, plywood, bamboo, ceramic material, such as tiles, and sponge or other three-dimensionally structured objects, among some others.

Also, as the recording apparatus described above, there are a printing apparatus that records on various paper and OHP sheets or the like; the recording apparatus for use of plastics to recording on the plastic material, such as compact discs; the recording apparatus for use of metals to record on the metallic plates; the recording apparatus for use of leathers to recording on them; the recording apparatus for use of woods to record on them; the recording apparatus for use of ceramics to record on ceramic materials; the recording apparatus for recording on sponge or some other three-dimensionally netted objects. Here, also, the textile printing apparatus is included for recording on cloths or the like.

Also, as discharge liquid used for each of these liquid discharge apparatuses, it should be good enough to use the liquid which is suitable for the respective recording media and recording conditions.

What is claimed is:

1. A liquid discharge head comprising:

a heating member for generating thermal energy to create bubble in a liquid;

a discharge port forming a portion to discharge the liquid;

a liquid flow path communicating with said discharge port, having a bubble generation area for enabling liquid to create a bubble;

a movable member arranged in said bubble generation area to be displaced along with development of the bubble; and a regulating member to regulate displacement of said movable member within a desired range, the liquid being discharged from said discharge port with energy in response to bubble creation, wherein said liquid flow path holds the bubble during bubbling, and is provided with a gap arranged on a side of said movable member to allow the liquid upstream of the movable member to flow into the bubble generation area when the bubble disappears.

2. A liquid discharge head according to claim 1, wherein said heating member and said discharge port are in a linearly communicating state.

3. A liquid discharge head according to claim 1, wherein said movable member is arranged to suppress only bubble development upstream of said movable member.

4. A liquid discharge head according to claim 1, wherein said movable member is provided with a free end, and said free end is positioned substantially at a central portion of said bubble generation area.

5. A liquid discharge head according to claim 1, wherein flow resistance of said liquid flow path is lower upstream of said regulating member than downstream of said regulating member, when said movable member is on standby.

6. A liquid discharge head according to claim 4, wherein contact of said movable member with said regulating member is made in the vicinity of said free end.

7. A liquid discharge head according to claim 1, wherein said liquid flow path has a wall, and wherein said regulating member comprises a portion of said wall whose distance is locally smaller from said movable member.

8. A liquid discharge head according to claim 1, wherein said gap is 8 to 13 $\mu$m in width.

9. A liquid discharge head according to claim 1, wherein said discharge port is arranged above said heating member.

10. A liquid discharge head according to claim 9, comprising plural said movable members per heating member, and wherein said plural movable members are formed symmetrically with respect to a bubbling center of said heating member.

11. A liquid discharge head comprising:

a heating member for generating thermal energy to create a bubble in a liquid;

a discharge port forming a portion to discharge the liquid;

a liquid flow path communicating with said discharge port, having a bubble generation area for enabling the liquid to create the bubble;

a movable member having a free end, and arranged in said bubble generation area to be displaced along with development of the bubble; and a regulating member to regulate displacement of said movable member within a desired range, the liquid being discharged from said discharge port with energy in response to bubble creation, wherein said regulating member is arranged to face said bubble generation area of said liquid flow path, and said liquid flow path having said bubble generation area becomes an essentially closed space except for said discharge port when said free end of said displaced movable member is substantially in contact with said regulating member, and said movable member is displaced to be resiliently extruded in an upstream direction before the bubble presents its maximum volume, and then, an extruded portion of said movable member is displaced in a downstream direction by its own resiliency during bubble contraction.

12. A liquid discharge head according to claim 11, wherein said heating member and said discharge port are in a linearly communicating state.

13. A liquid discharge head according to claim 11, wherein said movable member is arranged to suppress only bubble development upstream of said movable member.

14. A liquid discharge head according to claim 11, wherein said free end of said movable member is positioned substantially at a central portion of said bubble generation area.

15. A liquid discharge head according to claim 14, wherein contact of said movable member with said regulating member is made in a vicinity of said free end.

16. A liquid discharge head according to claim 11, wherein flow resistance of said liquid flow path is lower upstream of said regulating member than downstream of said regulating member, when said movable member is on standby.

17. A liquid discharge head according to claim 11, wherein said liquid flow path has a wall, and wherein said regulating member comprises a portion of said wall whose distance is locally smaller from the movable member in said liquid flow path.

18. A liquid discharge head according to claim 11, wherein said discharge port is arranged above said heating member.

19. A liquid discharge head according to claim 18, comprising plural said movable members per heating member, and wherein said plural movable members are formed symmetrically with respect to a bubbling center of said heating member.

20. A liquid discharge head comprising:

a heating member for generating thermal energy to create a bubble in a liquid;

a discharge port forming a portion to discharge the liquid;

a liquid flow path communicating with said discharge port, having a bubble generation area for enabling the liquid to create the bubble;

a movable member arranged in said bubble generation area to be displaced along with development of the bubble; and a regulating member to regulate displacement of said movable member within a desired range, the liquid being discharged from said discharge port with energy in response to bubble creation, wherein said liquid flow path having said bubble generation area becomes an essentially closed space except for said discharge port when said displaced movable member is substantially in contact with said regulating member, and the bubble does not block liquid flow in said space at a time of maximum bubbling.

21. A liquid discharge head according to claim 20, wherein said heating member and said discharge port are in a linearly communicating state.

22. A liquid discharge head according to claim 20, wherein said movable member is arranged to suppress only bubble development upstream of said movable member.

23. A liquid discharge head according to claim 20, wherein said movable member is provided with a free end, and said free end is positioned substantially at a central portion of said bubble generation area.

24. A liquid discharge head according to claim 23, wherein contact of said movable member with said regulating member is made in a vicinity of said free end.

25. A liquid discharge head according to claim 20, wherein flow resistance of said liquid flow path is lower upstream of said regulating member than downstream of said regulating member, when said movable member is on standby.

26. A liquid discharge head according to claim 20, wherein said liquid flow portion has a wall, and wherein said regulating member comprises a portion of said wall whose distance is locally smaller from said movable member in said liquid flow path.

27. A liquid discharge head according to claim 20, wherein said discharge port is arranged above said heating member.

28. A liquid discharge head according to claim 27, comprising plural said movable members per heating member, and wherein said plural movable members are formed symmetrically with respect to a bubbling center of said heating member.

29. A liquid discharge head comprising:

a heating member for generating thermal energy to create a bubble in a liquid;

a discharge port forming a portion to discharge the liquid;

a liquid flow path communicating with said discharge port, having a bubble generation area for enabling liquid to create the bubble;

a movable member arranged in said bubble generation area to be displaced along with development of the bubble; and a regulating member to regulate displacement of said movable member within a desired range, the liquid being discharged from said discharge port with energy in response to bubble creation, wherein said liquid flow path having said bubble generation area becomes an essentially closed space except for said discharge port when said displaced movable member is substantially in contact with said regulating member, and the liquid facing said movable member when the bubble is developed to its maximum remains connected continuously with the liquid downstream of said bubble generation area.

30. A liquid discharge head comprising:

a heating member for generating thermal energy to create a bubble in a liquid;

a discharge port forming a portion to discharge a liquid;

a liquid flow path communicating with said discharge port, having a bubble generation area for enabling the liquid to create the bubble;

said liquid flow path having a bubble generation area for enabling the liquid to create the bubble;

a movable member arranged in said bubble generation area to be displaced along with development of the bubble; and a regulating member to regulate displacement of said movable member within a desired range, the liquid being discharged from said discharge port with energy at a time of bubble creation, wherein said liquid flow path having said bubble generation area becomes an essentially closed space except for said discharge port when said displaced movable member is substantially in contact with said regulating member, and the bubble does not cover a substantially contacted portion of said movable member at a time of maximum bubbling.

31. A liquid discharge head comprising:

a heating member for heating liquid in a liquid flow path to create a bubble in the liquid;

a discharge port communicating with a downstream portion of said liquid flow path for discharging the liquid by pressure along with development of the bubble;

said liquid flow path having a bubble generation area for enabling the liquid to create the bubble;

a movable member arranged in said bubble generation area to be displaced along with development of the bubble;

a regulating member to regulate displacement of said movable member within a desired range, said heating member and said discharge port being in a linearly communicating state, respectively, the liquid being discharged from said discharge port with energy in response to bubble creation, wherein said regulating member is arranged to face said bubble generation area, and said liquid flow path having said bubble generation area becomes an essentially closed space except for said discharge port when said displaced movable member is substantially in contact with said regulating member, and said movable member covers a part of said heating member at a time of bubble extinction so as to cause the liquid on an area covered by said movable member to flow out from a side of said movable member.

32. A liquid discharge head according to claim 31, wherein the liquid flows out from upstream of said heating member.

33. A liquid discharge head according to claim 31, wherein said movable member is arranged to suppress only bubble development upstream of said movable member.

34. A liquid discharge head according to claim 31, wherein said movable member is provided with a free end, and said free end is positioned substantially at a central portion of said bubble generation area.

35. A liquid discharge head according to claim 34, wherein contact of said movable member with said regulating member is made in a vicinity of said free end.

36. A liquid discharge head according to claim 31, wherein flow resistance of said liquid flow path is lower upstream of said regulating member than downstream of said regulating member, when said movable member is on standby.

37. A liquid discharge head according to claim 31, wherein said liquid flow path has a wall, and wherein said regulating member comprises a portion of said wall whose distance is locally smaller from the movable member in said liquid flow path.

38. A liquid discharge head according to claim 31, wherein said discharge port is arranged above said heating member.

39. A liquid discharge head according to claim 38, comprising plural said movable members per heating member, and wherein each said plural movable member is formed symmetrically with respect to a bubbling center of a respective heating member.

40. A liquid discharge head according to claim 31, comprising a liquid chamber for supplying the liquid to said liquid flow path.

41. A liquid discharge head according to claim 40, further comprising a substrate for said movable member, and a supporting member formed on said substrate for said movable member, and wherein said supporting member is arranged in said liquid chamber portion, and a distance between said movable member and said heating member is 10 $\mu$m or less.

42. A liquid discharge head according to claim 40, wherein the liquid flows out on said liquid chamber.

43. A liquid discharge head comprising:

a heating member for heating liquid in a liquid flow path to create a bubble in the liquid;

a discharge port communicating with a downstream side of said liquid flow path for discharging the liquid by pressure along with the development of the bubble;

said liquid flow path having a bubble generation area for enabling the liquid to create the bubble;

a movable member arranged in said bubble generation area to be displaced along with development of the bubble;

a regulating member to regulate displacement of said movable member within a desired range, the liquid being discharged from said discharge port with energy in response to bubble creation, wherein said regulating member is arranged to face said bubble generation area, and said liquid flow path having said bubble generation area becomes an essentially closed space except for said discharge port when said displaced movable member is substantially in contact with said regulating member, and said movable member covers a point of extinction of the bubble at a time of bubble extinction.

44. A liquid discharge head according to claim 43, wherein said movable member is arranged to suppress only bubble development upstream of said movable member.

45. A liquid discharge head according to claim 43, wherein said movable member is provided with a free end, and said free end is positioned substantially on a central portion of said bubble generation area.

46. A liquid discharge head according to claim 45, wherein contact of said movable member with said regulating member is made in a vicinity of said free end.

47. A liquid discharge head according to claim 43, wherein flow resistance of said liquid flow path is lower upstream of said regulating member than downstream of said regulating member, when said movable member is on standby.

48. A liquid discharge head according to claim 43, wherein said liquid flow path has a wall, and wherein said regulating member comprises a portion of said wall whose distance is locally smaller from the movable member in said liquid flow path.

49. A liquid discharge head according to claim 43, wherein said discharge port is arranged above said heating member.

50. A liquid discharge head according to claim 49, comprising plural said movable members per heating member, and wherein each said plural movable member is formed symmetrically with respect to a bubbling center of a respective heating member.

51. A liquid discharge head comprising:

a discharge port for discharging liquid;

a liquid flow path communicating with said discharge port, having a plurality of bubble generation areas for enabling the liquid to create a bubble; and a movable member arranged in said liquid flow path to face said bubble generation areas, having a free end on a downstream side with respect to liquid flow in a direction toward said discharge port, said movable member being arranged only in an upstream-most one of said bubble generation areas.

52. A liquid discharge head according to claim 51, further comprising a regulating member to regulate displacement of said movable member along with development of the bubble, and said liquid flow path being essentially divided in a liquid flow direction toward said discharge port by said movable member displaced to be substantially in contact with said regulating member.

53. A liquid discharge head according to claim 51, wherein said movable member has a free end, and said free end is substantially positioned on a central portion of said upstream-most bubble generation area.

54. A liquid discharge head according to claim 51, wherein a downstream-most one of said bubble generation areas is smaller in area than is said upstream-most bubble generation area.

55. A liquid discharge head according to claim 51, comprising plural ones of said heating member, for each of said bubble generation areas, respectively.

56. A liquid discharge head according to claim 55, wherein each of said heating members can be driven individually.

57. A liquid discharge apparatus comprising:

a liquid discharge head according to claim 1 or claim 56; and means for carrying a recording medium to receive liquid discharged from said liquid discharge head.

58. A liquid discharge apparatus according to claim 57, wherein ink is discharged from said liquid discharge head for the adhesion of ink to the recording medium, for recording.

59. A liquid discharge method using a liquid discharge head provided with:

a heating member for generating thermal energy to create a bubble in a liquid;

a discharge port forming a portion to discharge the liquid;

a liquid flow path communicating with the discharge port, having a bubble generation area for enabling the liquid to create the bubble;

a movable member arranged in the bubble generation area to be displaced along with development of the bubble; and a regulating member to regulate displacement of the movable member within a desired range, the liquid being discharged from the discharge port with energy in response to bubble creation, said method comprising the steps of:

holding the bubble by the movable member when the bubble is developed; and enabling the liquid upstream of the movable member to flow into the bubble generation area through a gap provided at a side of the movable member, at a time of bubble disappearing.

60. A liquid discharge method according to claim 59, further comprising the steps of:

displacing the movable member along with development of the bubble; and extruding the bubble from the gap on the side of the movable member, with the movable member being in contact with the regulating member.

61. A liquid discharge method according to claim 59, further comprising the step of:

beginning bubble disappearing of the bubble after the movable member is in contact with the regulating member to receive a stress of being pulled in an upstream direction by a liquid shift in the upstream direction and the development of the bubble.

62. A liquid discharge method according to claim 59, further comprising the step of:

contracting the bubble with the movable member being still in contact with the regulating member.

63. A liquid discharge method according to claim 59, further comprising the step of:

enabling the liquid to flow into the bubble generation area from a side of the movable member, with the movable member being still in contact with the regulating member.

64. A liquid discharge method according to claim 62, wherein, in said step of contracting the bubble with the movable member being still in contact with the regulating member, a liquid shift along with contraction of the bubble is mostly directed from the discharge port in an upstream direction to draw a meniscus rapidly into the discharge port.

65. A liquid discharge method according to claim 64, wherein, during the bubble contraction process, the movable member is caused to part from the regulating member to create liquid flow in a downstream direction in the bubble generation area for abruptly braking the drawing of the meniscus.

66. A liquid discharge method using a liquid discharge head provided with:

a heating member for generating thermal energy to create a bubble in a liquid;

a discharge port forming a portion to discharge the liquid;

a liquid flow path communicating with the discharge port, having a bubble generation area for enabling the liquid to create the bubble;

a movable member arranged in the bubble generation area to be displaced along with development of the bubble; and a regulating member to regulate displacement of the movable member within a desired range, the liquid being discharged from the discharge port with energy in response to bubble creation, said method comprising the steps of:

contacting the movable member essentially with the regulating member before maximum bubbling of the bubble, displacing the movable member to be resiliently extruded to an upstream side to make the liquid flow path having the bubble generation area an essentially closed space except the discharge port; and displacing an extruded portion of the movable member to a downstream side by its own resiliency in a stage of contracting the bubble.

67. A liquid discharge method according to claim 66, further comprising the step of:

contracting the bubble with the movable member being still essentially in contact with the regulating member.

68. A liquid discharge method according to claim 67, wherein, in said step of contracting the bubble with the movable member being still in contact with the regulating member, a liquid shift along with contraction of the bubble is mostly directed from the discharge port in an upstream direction, to draw a meniscus rapidly into the discharge port.

69. A liquid discharge method according to claim 68, wherein, during bubble contraction process, the movable member is caused to part from the regulating member to create a liquid flow in a downstream direction in the bubble generation area, for abruptly braking the drawing of the meniscus.

70. A liquid discharge method using a liquid discharge head provided with:

a heating member for generating thermal energy to create a bubble in a liquid;

a discharge port forming a portion to discharge the liquid;

a liquid flow path communicating with the discharge port, having a bubble generation area for enabling the liquid to create the bubble, a movable member arranged in the bubble generation area to be displaced along with development of the bubble; and a regulating member to regulate displacement of the movable member within a desired range, the liquid being discharged from the discharge port with energy in response to bubble creation, said method comprising the step of:

contacting the movable member essentially with the regulating member before maximum bubbling of bubble, allowing no bubble to block liquid flow in the bubble generation space at a time of maximum bubbling.

71. A liquid discharge method according to claim 70, further comprising the step of:

beginning bubble disappearing of the bubble after the movable member is in contact with the regulating member to receive a stress of being pulled in an upstream direction by a liquid shift in the upstream direction and the development of the bubble.

72. A liquid discharge method according to claim 70, further comprising the step of:

contracting the bubble with the movable member being still essentially in contact with the regulating member.

73. A liquid discharge method according to claim 72, wherein, in said step of contracting the bubble with the movable member being still essentially in contact with the regulating member, a liquid shift along with the contraction of the bubble is mostly directed from the discharge port in an upstream direction, to draw a meniscus rapidly into the discharge port.

74. A liquid discharge method according to claim 73, wherein, during the bubble contraction process, the movable member is caused to part from the regulating member to create liquid flow in a downstream direction in the bubble generation area, for abruptly braking drawing of the meniscus.

75. A liquid discharge method using a liquid discharge head provided with:

a heating member for heating liquid in a liquid flow path to create a bubble in the liquid;

a discharge port communicating with a downstream side of the liquid flow path for discharging the liquid by pressure along with development of the bubble;

the liquid flow path having a bubble generation area for enabling the liquid to create the bubble;

a movable member arranged in the bubble generation area to be displaced along with development of the bubble;

a regulating member to regulate displacement of the movable member within a desired range, the liquid being discharged from the discharge port with energy in response to bubble creation, said method comprising the steps of:

contacting the movable member essentially with the regulating member before maximum bubbling of the bubble to make the liquid flow path having the bubble generation area an essentially closed space except for the discharge port;

enabling the movable member to cover a part of the heating member before disappearing of the bubble; and allowing the liquid on an area covered by the movable member to flow out from a side of the movable member.

76. A liquid discharge method according to claim 75, further comprising the step of:

beginning bubble disappearing of the bubble after the movable member is essentially in contact with the regulating member to receive a stress of being pulled in an upstream direction by a liquid shift in the upstream direction and the development of the bubble.

77. A liquid discharge method according to claim 75, further comprising the step of:

contracting the bubble with the movable member being still essentially in contact with the regulating member.

78. A liquid discharge method according to claim 77, wherein, in said step of contracting the bubble with the movable member being still essentially in contact with the regulating member, a liquid shift along with the contraction of the bubble is mostly directed from the discharge port in an upstream direction, to draw a meniscus rapidly into the discharge port.

79. A liquid discharge method according to claim 78, wherein, during the bubble contraction process, the movable member is caused to part from the regulating member to create a liquid flow in a downstream direction in the bubble generation area for abruptly braking drawing of the meniscus.

80. A liquid discharge method according to claim 77, wherein the liquid is caused to flow out upstream of the heating member.

81. A liquid discharge method using a liquid discharge head provided with:

a heating member for heating liquid in a liquid flow path to create a bubble in the liquid;

a discharge port communicating with a downstream side of the liquid flow path for discharging the liquid by pressure along with development of the bubble;

the liquid flow path having a bubble generation area for enabling the liquid to create the bubble;

a movable member arranged in the bubble generation area to be displaced along with development of the bubble;

a regulating member to regulate displacement of the movable member within a desired range, the liquid being discharged from the discharge port with energy in response to bubble creation, said method comprising the steps of:

contacting the movable member essentially with the regulating member before maximum bubbling of the bubble to make the liquid flow path having the bubble generation area an essentially closed space; and enabling the movable member to cover a disappearing point of the bubble at a time of disappearing of the bubble.

82. A liquid discharge method according to claim 81, wherein a flow of liquid flowing in the bubble generation area when the movable member opens the essentially closed space and a flow of liquid forward toward a heating member side from a discharge port side along with contraction of the bubble are layeredly formed, and a disappearing point of the bubble shifts into the bubble generation area opposed to the movable member.

83. A liquid discharge method according to claim 81, further comprising the step of:

beginning bubble disappearing of the bubble after the movable member is essentially in contact with the regulating member to receive a stress of being pulled in an upstream direction by a liquid shift in the upstream direction and the development of the bubble.

84. A liquid discharge method according to claim 81, further comprising the step of:

contracting the bubble with the movable member being still essentially in contact with the regulating member.

85. A liquid discharge method according to claim 84, wherein, in said step of contracting the bubble with the movable member being still essentially in contact with the regulating member, a liquid shift along with the contraction of the bubble is mostly directed from the discharge port in an upstream direction, to draw a meniscus rapidly into the discharge port.

86. A liquid discharge method according to claim 85, wherein, during the bubble contraction process, the movable member is caused to part from the regulating member to create liquid flow in a downstream direction in the bubble generation area for abruptly braking drawing of the meniscus.

* * * * *